US012704281B2

(12) United States Patent
Shinmoto et al.

(10) Patent No.: US 12,704,281 B2
(45) Date of Patent: Aug. 11, 2026

(54) AIR CONDITIONING SYSTEM WITH PARSER PROCESSING OF COMMUNICATED DATA SERVER

(71) Applicant: Mitsubishi Electric Corporation, Tokyo (JP)

(72) Inventors: Daiki Shinmoto, Tokyo (JP); Tomoo Nakano, Tokyo (JP); Katsuhiro Hirose, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 324 days.

(21) Appl. No.: 18/560,808

(22) PCT Filed: Jul. 12, 2021

(86) PCT No.: PCT/JP2021/026135

§ 371 (c)(1),
(2) Date: Nov. 14, 2023

(87) PCT Pub. No.: WO2023/286127

PCT Pub. Date: Jan. 19, 2023

(65) Prior Publication Data

US 2024/0247832 A1 Jul. 25, 2024

(51) Int. Cl.
*F24F 11/58* (2018.01)
*F24F 11/56* (2018.01)

(52) U.S. Cl.
CPC ..... *F24F 11/58* (2018.01)

(58) Field of Classification Search
None
See application file for complete search history.

(56) References Cited

U.S. PATENT DOCUMENTS 10,119,713 B2 * 11/2018 Castillo ..... F24F 11/523
11,488,077 B1 * 11/2022 Lyman ..... H04L 12/2825
2003/0033392 A1 2/2003 Nakamura et al.
2010/0325270 A1 12/2010 Ishizaka
2012/0017619 A1 * 1/2012 Yabuta ..... F24F 11/65 62/129

(Continued)

FOREIGN PATENT DOCUMENTS

JP 2003-056889 A 2/2003
JP 2005-140419 A 6/2005

(Continued)

OTHER PUBLICATIONS

International Search Report of the International Searching Authority mailed Sep. 7, 2021 for the corresponding International Application No. PCT/JP2021/026135 (and English translation).

(Continued)

*Primary Examiner* — Ariel Mercado-Vargas
(74) *Attorney, Agent, or Firm* — Posz Law Group, PLC

(57) ABSTRACT

An air conditioning system comprises an air conditioner, a remote monitoring device to monitor the air conditioner, and a server device to communicate with the remote monitoring device. The server device comprises a communication unit to transmit and receive data to and from the remote monitoring device, and a parser processing unit to perform a process related to monitoring of the air conditioner by the remote monitoring device.

11 Claims, 13 Drawing Sheets

(56) References Cited

U.S. PATENT DOCUMENTS

| | | | | |
|---|---|---|---|---|
| 2016/0102877 | A1* | 4/2016 | Griffin | F24F 11/38 700/276 |
| 2016/0154576 | A1* | 6/2016 | Moore | G06F 3/04847 715/708 |
| 2016/0217674 | A1* | 7/2016 | Stewart | F24F 11/38 |
| 2018/0232459 | A1* | 8/2018 | Park | G06F 16/9024 |
| 2018/0320918 | A1* | 11/2018 | Kojima | G05B 19/02 |
| 2018/0356115 | A1* | 12/2018 | Koizumi | F24F 11/56 |
| 2019/0391819 | A1 | 12/2019 | Ito et al. | |
| 2021/0239345 | A1* | 8/2021 | Arensmeier | F24F 11/64 |
| 2022/0342989 | A1* | 10/2022 | Bunker | G08B 13/19691 |

FOREIGN PATENT DOCUMENTS

| | | | |
|---|---|---|---|
| JP | 2010-181073 | A | 8/2010 |
| WO | 2009/118877 | A1 | 10/2009 |
| WO | 2018/167821 | A1 | 9/2018 |

OTHER PUBLICATIONS

Office Action dated Jan. 28, 2025 issued in the corresponding Japanese Patent Application No. 2023-534451 (and English translation).

Office Action dated Apr. 30, 2026 issued in the corresponding Chinese Patent Application No. 202180099836.X (and English Translation).

* cited by examiner

AIR CONDITIONING SYSTEM WITH PARSER PROCESSING OF COMMUNICATED DATA SERVER

CROSS REFERENCE TO RELATED APPLICATION

This application is a U.S. national stage application of PCT/JP2021/026135 filed on Jul. 12, 2021, the contents of which are incorporated herein by reference.

TECHNICAL FIELD

The present disclosure relates to an air conditioning system.

BACKGROUND ART

Updating control software of an air conditioner to add a new function to the air conditioner has conventionally been known.

Japanese Patent Laying-Open No. 2003-56889 (PTL 1) discloses a system that allows the user to update control software of an air conditioner using data provided through the Internet or a memory card.

CITATION LIST

Patent Literature

PTL 1: Japanese Patent Laying-Open No. 2003-56889

SUMMARY OF INVENTION

Technical Problem

In the system disclosed in Japanese Patent Laying-Open No. 2003-56889, the user has to update control software of an air conditioner to add a new function to the air conditioner, which is burdensome for the user.

With the recent widespread use of Internet of Things (IOT) devices, there are air conditioning systems that monitor an air conditioner with a remote monitoring device and collect data on the air conditioner with a server device communicatively connected to the remote monitoring device. Even in such an air conditioning system, with the addition of a new function, the user has to update control software for each of the air conditioner and the remote monitoring device, and this is burdensome for the user.

The present disclosure is made to solve the above problem and an object of the present disclosure is to provide an air conditioning system in which updating of an air conditioner and a remote monitoring device does not impose a burden on users.

Solution to Problem

An air conditioning system according to the present disclosure includes an air conditioner, a remote monitoring device to monitor the air conditioner, and a server device to communicate with the remote monitoring device. The server device includes a communication unit to transmit and receive data to and from the remote monitoring device, and a parser processing unit to perform a process related to monitoring of the air conditioner by the remote monitoring device.

Advantageous Effects of Invention

The air conditioning system according to the present disclosure can update a process related to monitoring of the air conditioner by the remote monitoring device by updating the server device, without updating each of the air conditioner and the remote monitoring device, and therefore does not impose a burden of updating the air conditioner and the remote monitoring device on users.

DESCRIPTION OF EMBODIMENTS

Figure 1:
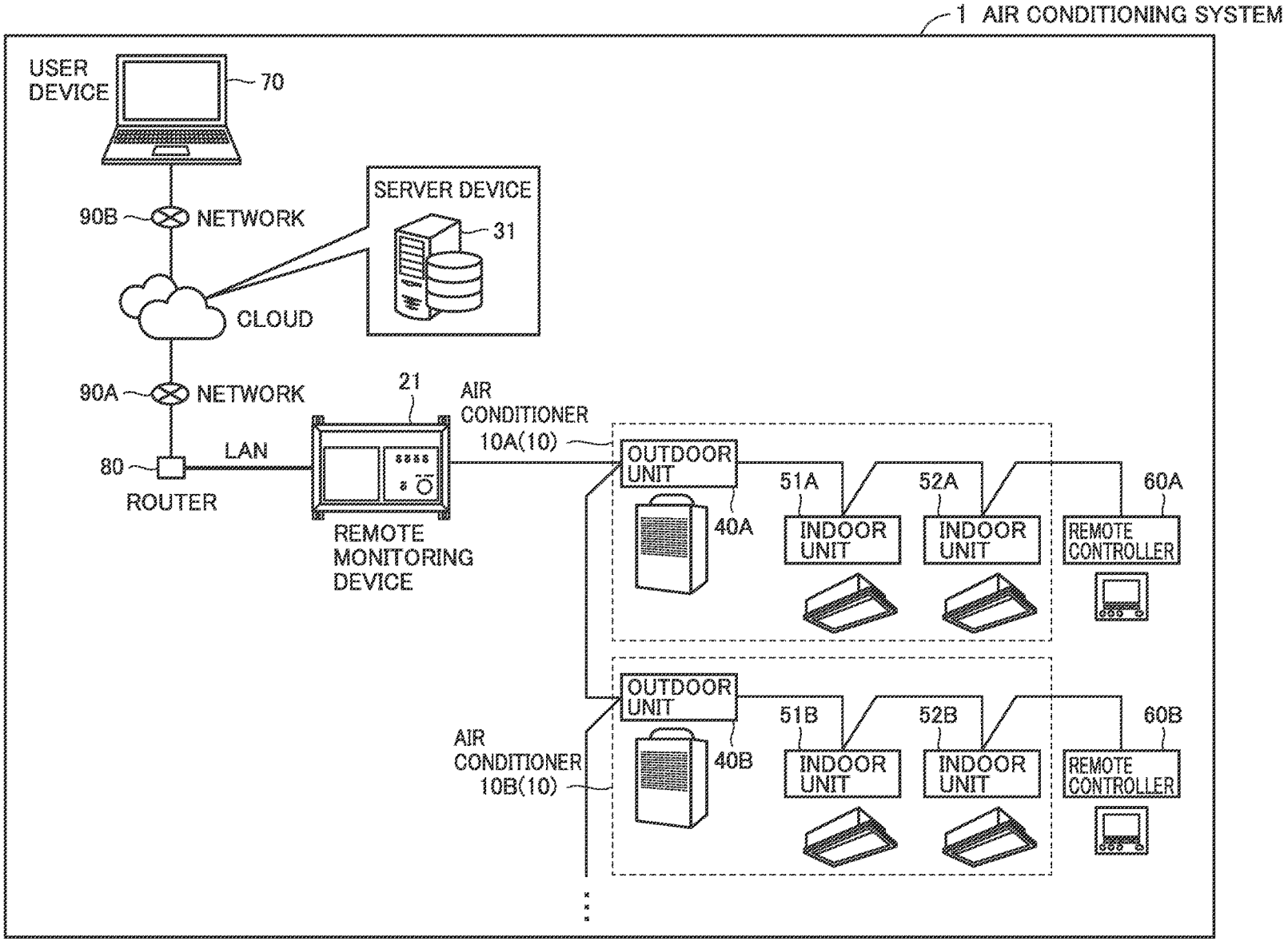
FIG. 1 is a diagram showing an overall configuration of an air conditioning system according to a first embodiment.

Embodiments of the present disclosure will be described in detail below with reference to the drawings. In the following, a plurality of embodiments will be described and it is initially intended at the time of filing to combine the configurations described in the embodiments as appropriate. The same or corresponding parts in the drawings are denoted by the same reference signs and a description thereof will not be repeated.

First Embodiment

Referring to FIG. 1 to FIG. 5, an air conditioning system 1 according to a first embodiment will be described. FIG. 1 is a diagram showing an overall configuration of air conditioning system 1 according to the first embodiment. As shown in FIG. 1, air conditioning system 1 includes an air conditioner 10, a remote monitoring device 21, a server device 31, and a user device 70.

Remote monitoring device 21 is communicatively connected to at least one air conditioner 10. For example, remote monitoring device 21 is communicatively connected to each of an air conditioner 10A and an air conditioner 10B. Air conditioner 10A includes an outdoor unit 40A, an indoor unit 51A, and an indoor unit 52A and is communicatively connected to a remote controller 60A. Air conditioner 10A configured in this manner adjusts the temperature, humidity, or the like of the air sucked from an interior space, based on operation of remote controller 60A, and supplies the adjusted air to the interior space. Air conditioner 10B includes an outdoor unit 40B, an indoor unit 51B, and an indoor unit 52B and is communicatively connected to a remote controller 60B. Air conditioner 10B configured in this manner adjusts the temperature, humidity, or the like of the air sucked from an interior space, based on operation of remote controller 60B, and supplies the adjusted air to the interior space.

Remote monitoring device 21 monitors air conditioner 10 to perform collection of air conditioning data related to air conditioning of air conditioner 10, control of air conditioner 10, and the like.

Server device 31 is connected between remote monitoring device 21 and user device 70 in the form of cloud computing. Remote monitoring device 21 is connected to a router 80 through a local area network (LAN). Server device 31 is communicatively connected to router 80 through a network 90A. Such connection enables server device 31 to communicate with remote monitoring device 21. Furthermore, server device 31 is communicatively connected to user device 70 through a network 90B.

Server device 31 accumulates and stores air conditioning data of air conditioner collected by remote monitoring device 21. The air conditioning data includes, for example, data such as an operating status corresponding to ON or OFF, operation start time, operation end time, setting temperature, setting humidity, operation mode of cooling or heating, indoor temperature, and indoor humidity. The air conditioning data may include data such as refrigerant temperature and refrigerant pressure measured by a sensor installed at refrigerant piping.

Furthermore, server device 31 outputs data corresponding to various setting values input using user device 70 to remote monitoring device 21. Remote monitoring device 21 controls air conditioner 10 based on data acquired from server device 31.

Figure 2:
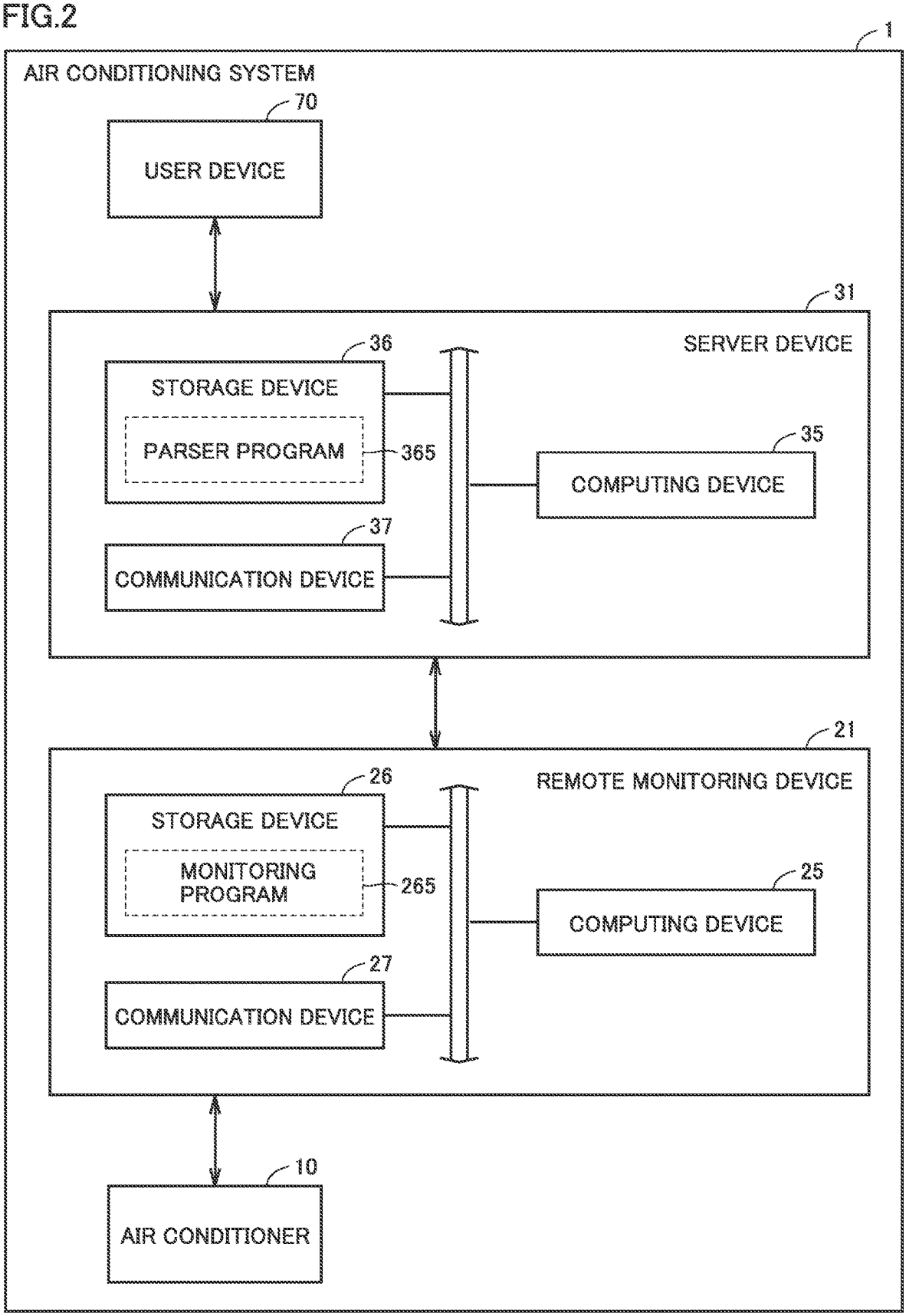
FIG. 2 is a diagram showing the configuration of each of a server device and a remote monitoring device according to the first embodiment.

FIG. 2 is a diagram showing a configuration of each of remote monitoring device 21 and server device 31 according to the first embodiment.

As shown in FIG. 2, remote monitoring device 21 includes a computing device 25, a storage device 26, and a communication device 27.

Computing device 25 is a computing entity (computer) that performs various processes under instructions of various programs. Computing device 25 includes, for example, at least one of a central processing unit (CPU), a field programmable gate array (FPGA), a graphics processing unit (GPU), and a multi-processing unit (MPU). Computing device 25 may further include a volatile memory such as a dynamic random access memory (DRAM) or a static random access memory (SRAM) and a nonvolatile memory such as a read only memory (ROM) or a flash memory. Computing device 25 may be configured with processing circuitry.

Storage device 26 includes a nonvolatile storage device such as a hard disk drive (HDD) or a solid state drive (SSD). Storage device 26 stores various programs and data referred to by computing device 25. Specifically, storage device 26 stores a monitoring program 265 for monitoring air conditioner 10.

Communication device 27 transmits/receives data (information) to/from each of air conditioner 10 and server device 31 via wired or wireless communication. For example, communication device 27 transmits/receives data to/from air conditioner 10 via wired communication. Furthermore, communication device 27 is connected to network 90A through the LAN and router 80 to transmit/receive data to/from server device 31. In this example, remote monitoring device 21 communicates with each of air conditioner 10 and server device 31 using one communication device 27. However, remote monitoring device 21 may communicate with each of air conditioner 10 and server device 31 using each of a plurality of communication devices 27.

As shown in FIG. 2, server device 31 includes a computing device 35, a storage device 36, and a communication device 37.

Computing device 35 is a computing entity (computer) that performs various processes under instructions of various programs. Computing device 35 includes, for example, at least one of a CPU, a FPGA, a GPU, and an MPU. Computing device 35 may further include a volatile memory such as a DRAM or an SRAM and a nonvolatile memory such as a ROM or a flash memory. Computing device 35 may be configured with processing circuitry.

Storage device 36 includes a nonvolatile storage device such as an HDD or an SSD. Storage device 36 stores various programs and data referred to by computing device 35. Specifically, storage device 36 stores a parser program 365 for performing a process related to monitoring of air conditioner 10 by remote monitoring device 21 (hereinafter also referred to as "parser process").

Communication device 37 transmits/receives data (information) to/from each of remote monitoring device 21 and user device 70 via wired or wireless communication. For example, communication device 37 is connected to network 90A to transmit/receive data to/from remote monitoring device 21. Communication device 37 is connected to network 90B to transmit/receive data to/from remote user device 70. In this example, server device 31 communicates with each of remote monitoring device 21 and user device 70 using one communication device 37. However, server device 31 may communicate with each of remote monitoring device 21 and user device 70 using each of a plurality of communication devices 37.

Figure 3:
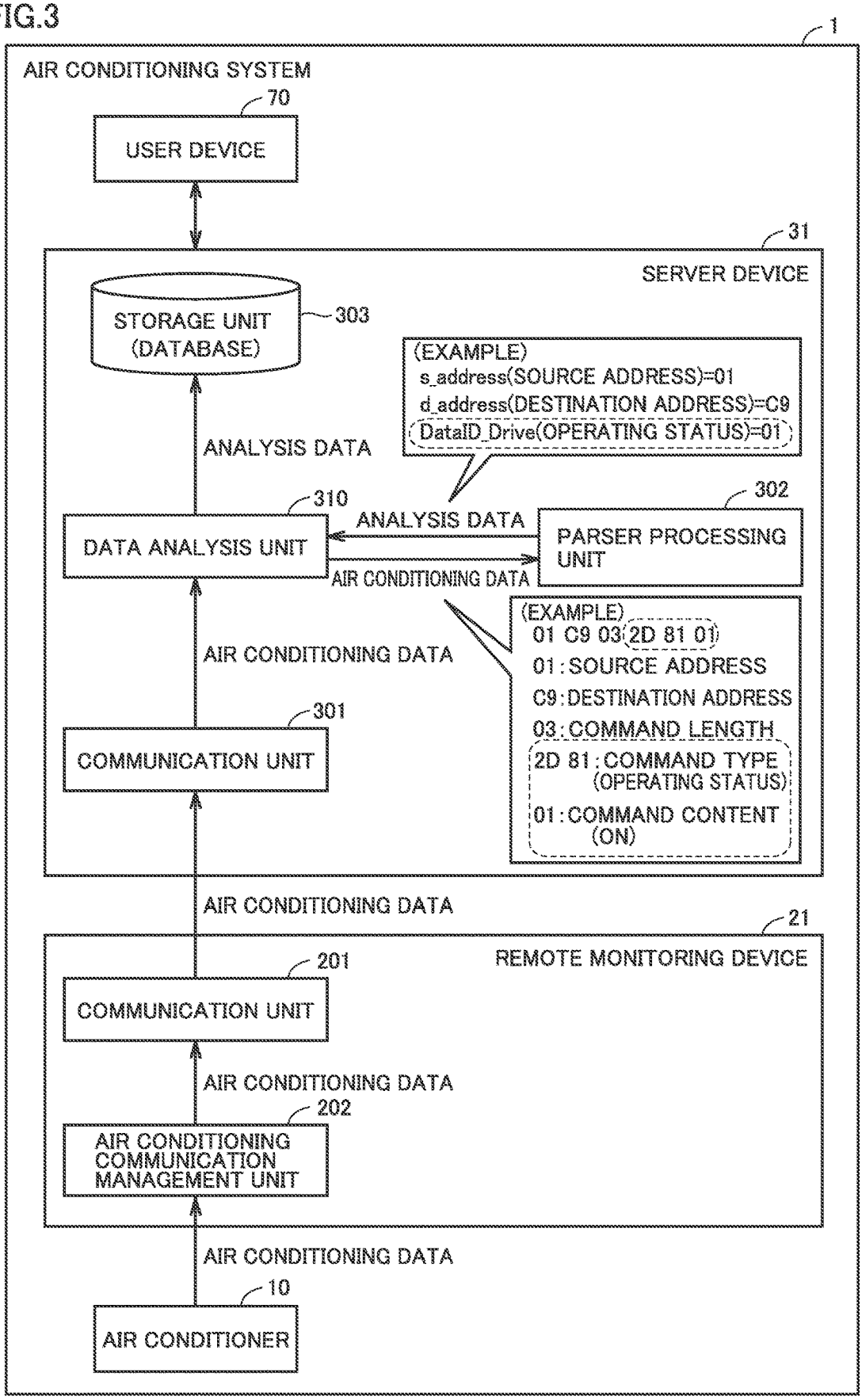
FIG. 3 is a diagram showing a functional configuration of the air conditioning system according to the first embodiment.

FIG. 3 is a diagram showing a functional configuration of the air conditioning system according to the first embodiment. As shown in FIG. 3, remote monitoring device 21 includes, as main functional units, a communication unit 201 and an air conditioning communication management unit 202. Each of communication unit 201 and air conditioning communication management unit 202 can be implemented by computing device 25 executing monitoring program 265 stored in storage device 26.

Server device 31 includes, as main functional units, a communication unit 301, a parser processing unit 302, a storage unit 303, and a data analysis unit 310. Each of communication unit 301, parser processing unit 302, and data analysis unit 310 can be implemented by computing device 35 executing parser program 365 stored in storage device 36. Storage unit 303 is a functional unit corresponding to storage device 36.

Server device 31 performs a parser process to analyze the air conditioning data of air conditioner 10 acquired from remote monitoring device 21 and stores the analysis result of the air conditioning data as a database.

Specifically, remote monitoring device 21 acquires air conditioning data output from air conditioner 10 through air conditioning communication management unit 202. Remote monitoring device 21 outputs air conditioning data to server device 31 through communication unit 201.

Server device 31 acquires air conditioning data output from remote monitoring device 21 through communication unit 301. Data analysis unit 310 of server device 31 outputs the air conditioning data acquired through communication unit 301 to parser processing unit 302 and requests parser processing unit 302 to analyze the air conditioning data. Server device 31 analyzes the air conditioning data using parser processing unit 302.

Here, FIG. 3 shows an example in which the air conditioning data acquired from air conditioner 10 is configured with 6-byte (48-bit) data including "01", "C9", "03", "2D", "81", and "01". The first byte "01" indicates the address of the source, that is, air conditioner 10. The second byte "C9" indicates the address of the destination, that is, server device 31. The third byte "03" indicates a command length. The fourth byte and fifth byte "2D81" indicates a command type and in this case indicates an operating status corresponding to ON or OFF. The sixth byte "01" indicates a command content and in this case indicates ON as an operating status.

Upon acquiring air conditioning data as described above, parser processing unit 302 extracts data to be stored into storage device 36 as a database from the acquired air conditioning data and converts the extracted data into the format in which storage device 36 stores it as a database.

For example, parser processing unit 302 extracts the source address data "01" from the air conditioning data and associates the extracted data "01" with "S address" indicating the source address in the database format. Parser processing unit 302 extracts the destination address data "C9" from the air conditioning data and associates the extracted data "C9" with "d_address" indicating the destination address in the database format. Parser processing unit 302 extracts the operating status data "01" from the air conditioning data and associates the extracted data "01" with "DataID_Drive" indicating the operating status in the database format.

After analyzing the air conditioning data as described above, parser processing unit 302 outputs analysis data including the analysis result of the air conditioning data to data analysis unit 310. In this example, the analysis data includes data "01" as "S_address", data "C9" as "d_address", and data "01" as "DataID_Drive". Server device 31 stores the analysis data acquired by data analysis unit 310 from parser processing unit 302 as a database using storage unit 303.

FIG. 3 shows an example in which the air conditioning data includes data indicating an operating status corresponding to ON or OFF, but the air conditioning data may include data indicating a content other than an operating status.

Figure 4:
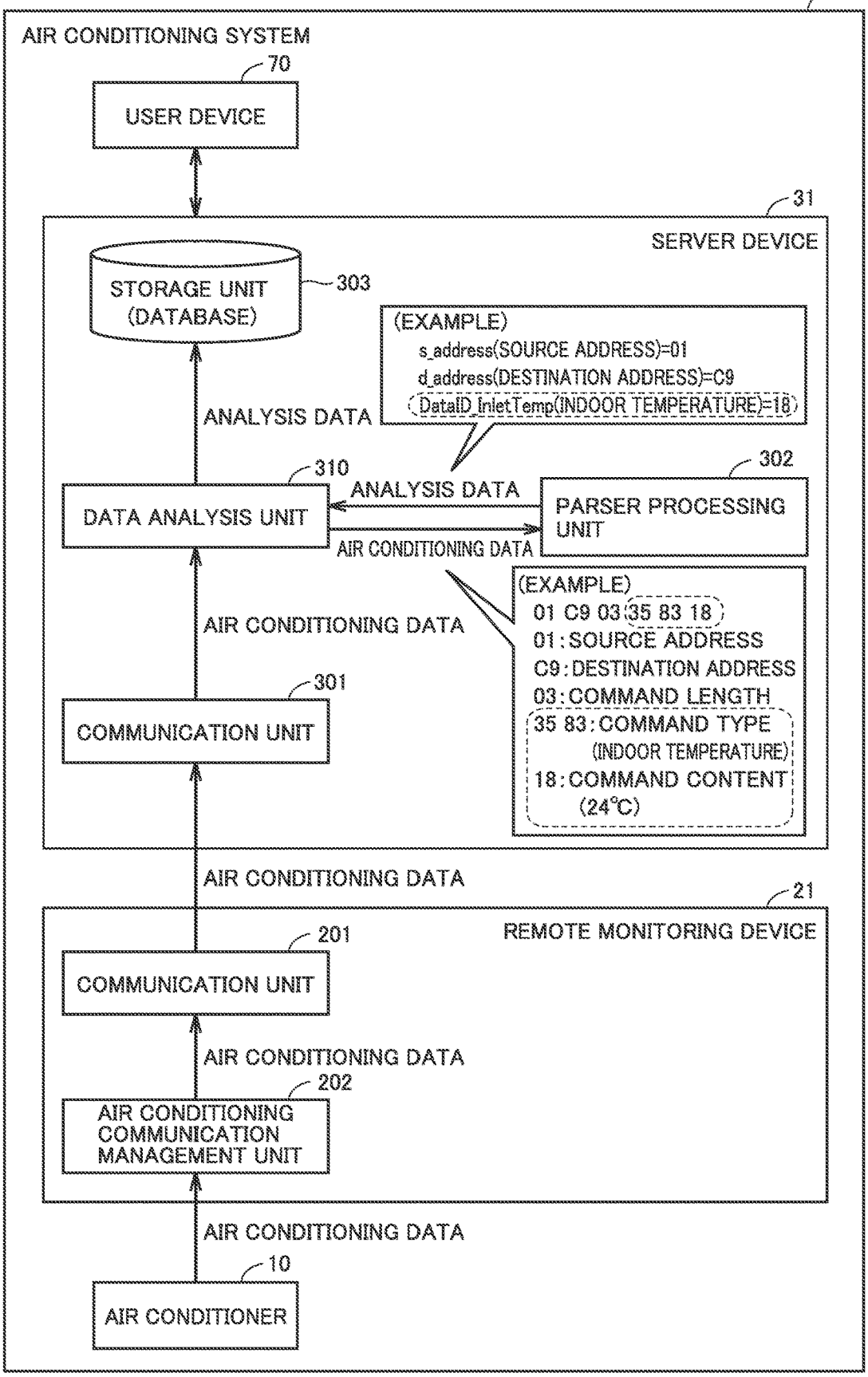
FIG. 4 is a diagram showing a functional configuration of the air conditioning system according to a modification of the first embodiment.

FIG. 4 is a diagram showing a functional configuration of air conditioning system 1 according to a modification of the first embodiment. FIG. 4 shows an example in which the air conditioning data acquired from air conditioner 10 is configured with 6-byte (48-bit) data including "01", "C9", "03", "35", "83", and "18". The first byte "01" indicates the address of the source, that is, air conditioner 10. The second byte "C9" indicates the address of the destination, that is, server device 31. The third byte "03" indicates a command length. The fourth byte and fifth byte "3583" indicates a command type and in this case indicates indoor temperature. The sixth byte "18" indicates a command content and in this example indicates 24 degrees Celsius as indoor temperature.

Parser processing unit 302 extracts the source address data "01" from the air conditioning data and associates the extracted data "01" with "S_address" indicating the source address in the database format. Parser processing unit 302 extracts the destination address data "C9" from the air conditioning data and associates the extracted data "C9" with "d_address" indicating the destination address in the database format. Parser processing unit 302 extracts the indoor temperature data "18" from the air conditioning data and associates the extracted data "18" with "DataID_InletTemp" indicating the indoor temperature in the database format.

After analyzing the air conditioning data as described above, parser processing unit 302 outputs analysis data including the analysis result of the air conditioning data to data analysis unit 310. In this example, the analysis data includes data "01" as "S_address", data "C9" as "d_address", and data "18" as "DataID_InletTemp". Server device 31 stores the analysis data acquired by data analysis unit 310 from parser processing unit 302 as a database using storage unit 303.

In addition to an operating status and indoor temperature, server device 31 may convert various data included in the air conditioning data, such as operation start time, operation end time, setting temperature, setting humidity, operation mode of cooling or heating, indoor humidity, refrigerant temperature, and refrigerant pressure, into the format of "DataID" and store the converted data as a database into storage device 36.

Figure 5:
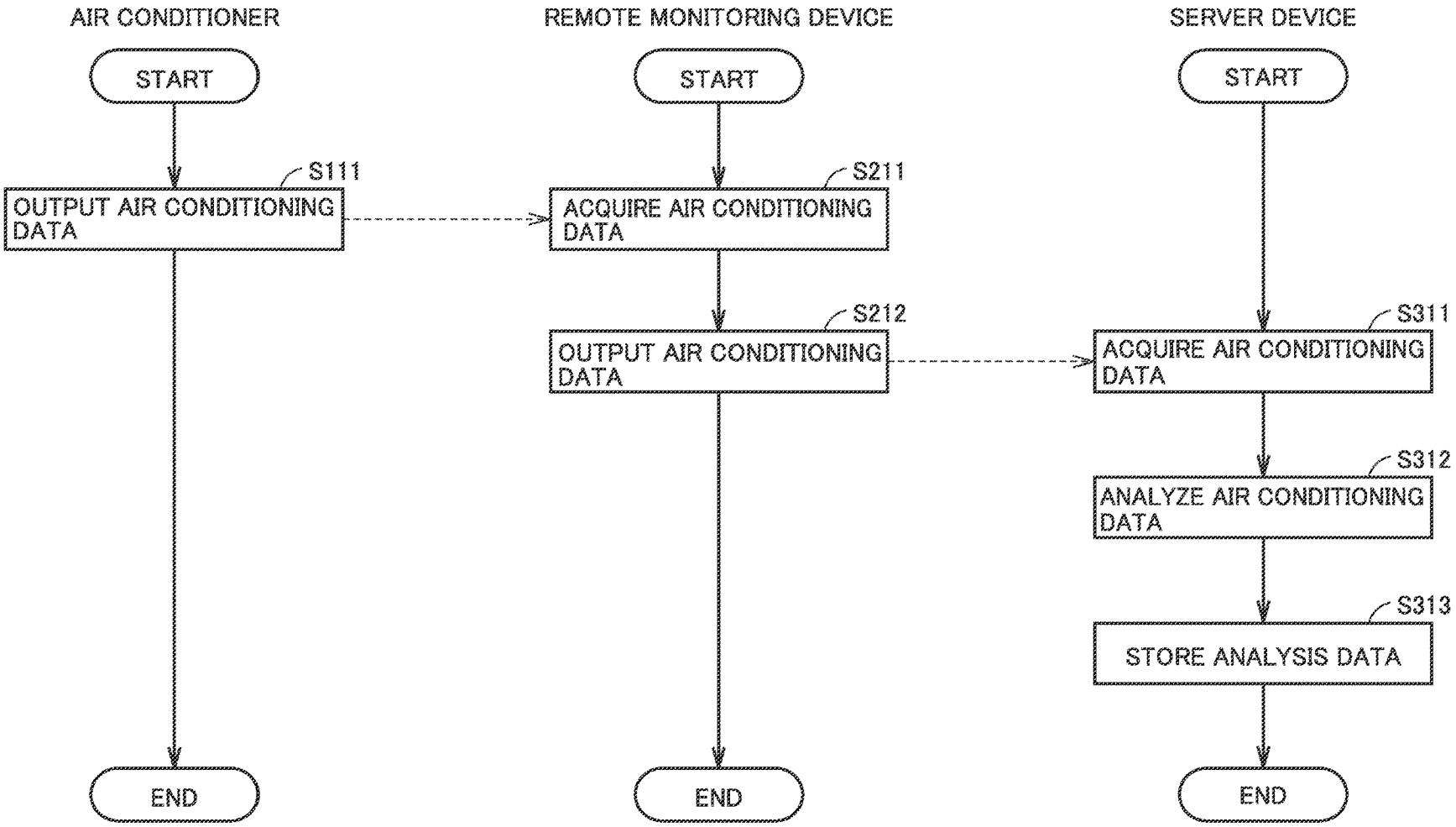
FIG. 5 is a flowchart showing a process of the air conditioning system according to the first embodiment.

FIG. 5 is a flowchart showing a process of air conditioning system 1 according to the first embodiment. Among the process steps (hereinafter abbreviated as "S") shown in FIG. 5, a process performed by server device 31 can be implemented by computing device 35 executing parser program 365. A process performed by remote monitoring device 21 can be implemented by computing device 25 executing monitoring program 265.

As shown in FIG. 5, air conditioner 10 outputs air conditioning data to remote monitoring device 21 (S111). Remote monitoring device 21 acquires the air conditioning data output from air conditioner 10 (S211). Remote monitoring device 21 outputs the air conditioning data to server device 31 (S212).

Server device 31 acquires the air conditioning data output from remote monitoring device 21 (S311). Server device 31 analyzes the air conditioning data using parser processing unit 302 and generates analysis data including the analysis result (S312). Server device 31 stores the analysis data into storage device 36 (S313).

In this way, in air conditioning system 1 according to the first embodiment, remote monitoring device 21 outputs the air conditioning data acquired from air conditioner 10 to server device 31 as it is without analyzing it. Server device 31 then analyzes the air conditioning data of air conditioner 10 acquired through remote monitoring device 21 and stores analysis data including the analysis result as a database into storage device 36.

With this configuration, even when a new function is added to air conditioner 10 or when a new air conditioner 10 with a new function is connected to remote monitoring device 21, remote monitoring device 21 outputs the air conditioning data acquired from air conditioner 10 to server device 31 as it is without analyzing it, so that server device 31 can analyze the air conditioning data. As a result, even when a new function is added to air conditioner 10 or when a new air conditioner 10 with a new function is connected to remote monitoring device 21, the user does not have to update remote monitoring device 21 and can store data corresponding to the new function as a database into storage device 36 only by updating server device 31. Air conditioning system 1 according to the first embodiment therefore does not impose a burden of updating air conditioner 10 and remote monitoring device 21 on the users.

Second Embodiment

Figure 6:
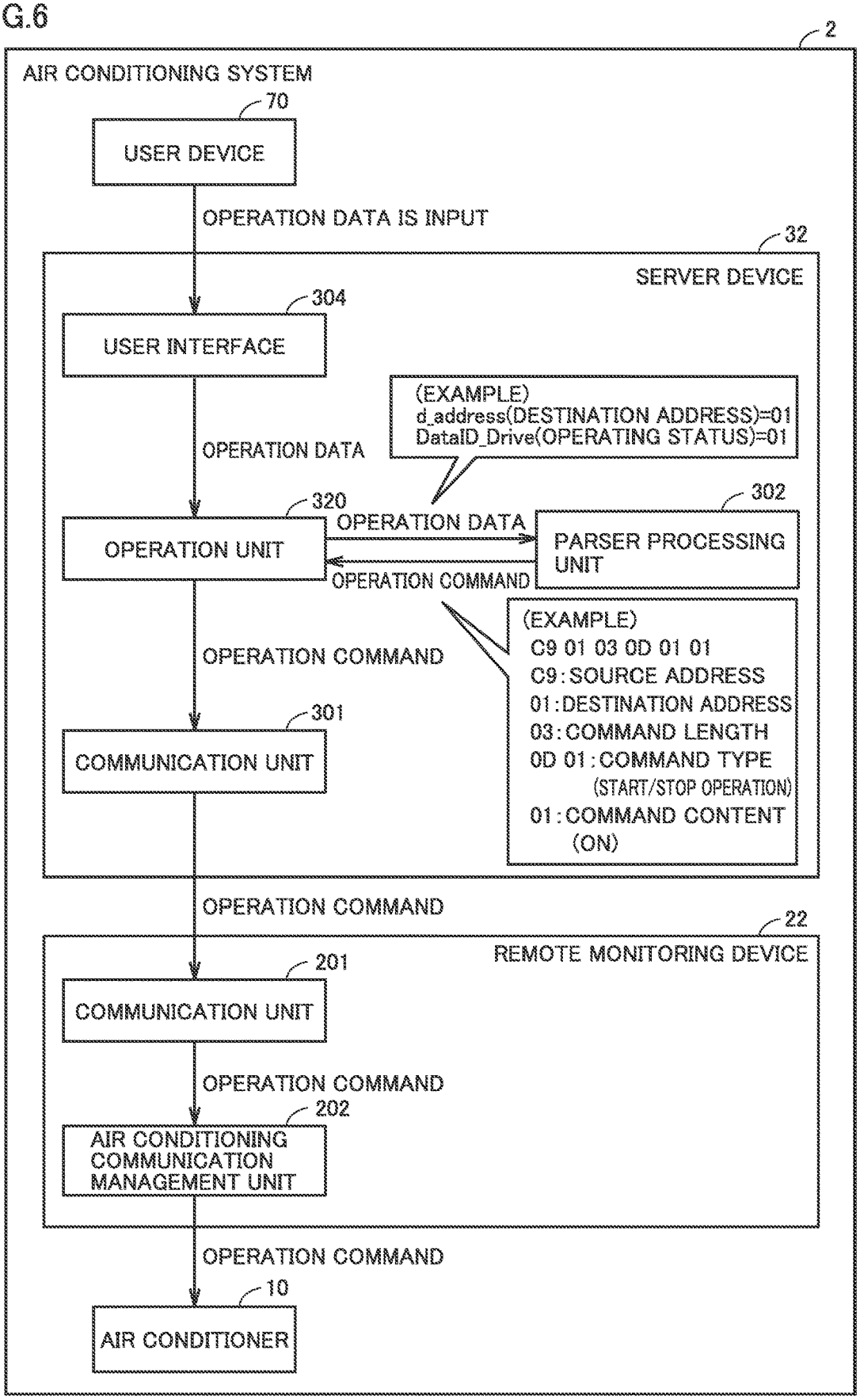
FIG. 6 is a diagram showing a functional configuration of an air conditioning system according to a second embodiment.
Figure 7:
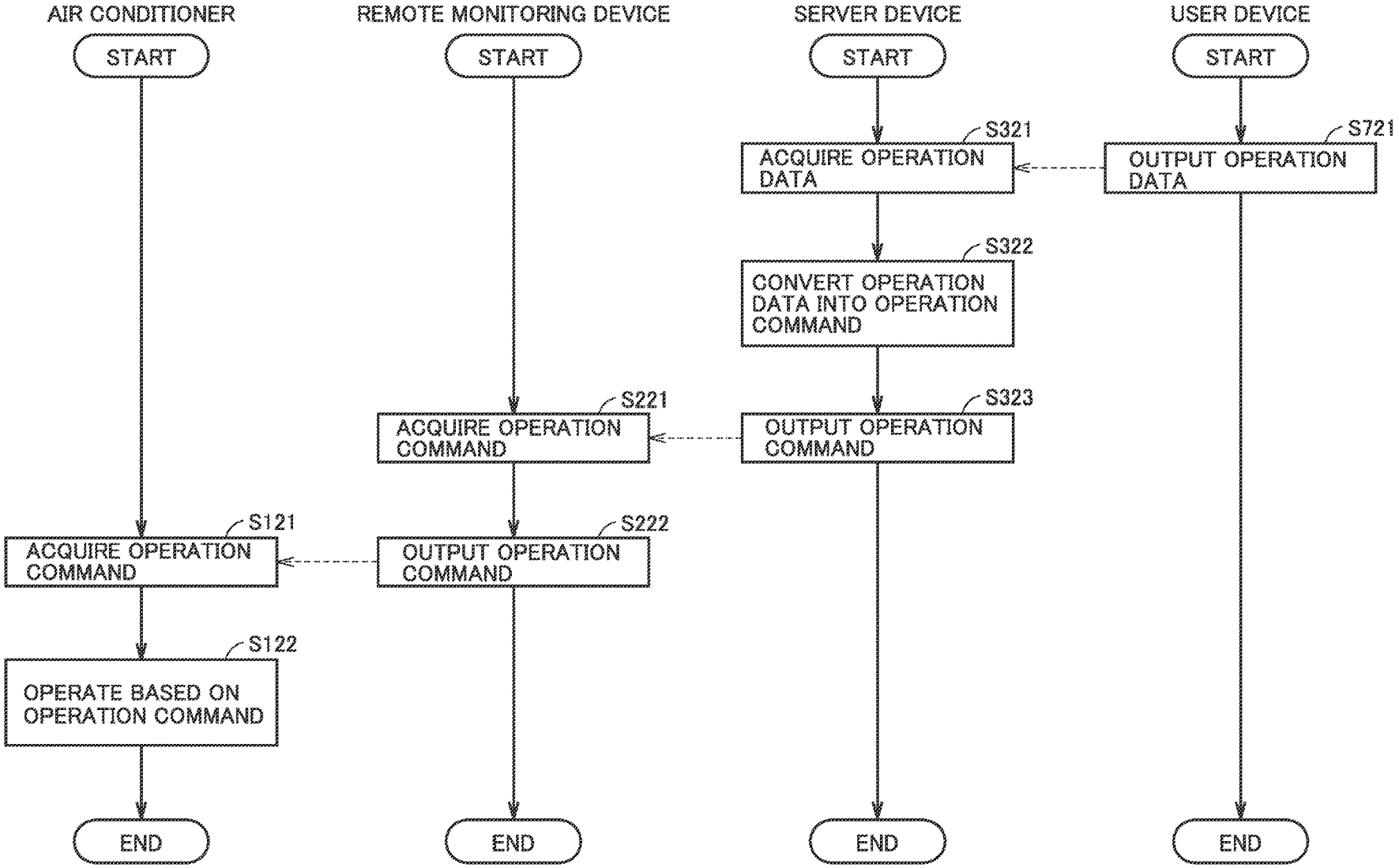
FIG. 7 is a flowchart showing a process of the air conditioning system according to the second embodiment.

Referring to FIG. 6 and FIG. 7, an air conditioning system 2 according to a second embodiment will be described. In the following, only the differences of air conditioning system 2 according to the second embodiment from air conditioning system 1 according to the first embodiment will be described.

FIG. 6 is a diagram showing a functional configuration of air conditioning system 2 according to the second embodiment. As shown in FIG. 6, air conditioning system 2 according to the second embodiment includes an air conditioner 10, a remote monitoring device 22, a server device 32, and a user device 70.

Remote monitoring device 22 according to the second embodiment includes a hardware configuration similar to that of remote monitoring device 21 according to the first embodiment and includes, as main functional units, a communication unit 201 and an air conditioning communication management unit 202. Each of communication unit 201 and air conditioning communication management unit 202 can be implemented by computing device 25 executing monitoring program 265 stored in storage device 26.

Server device 32 according to the second embodiment includes a hardware configuration similar to that of server device 31 according to the first embodiment and includes, as main functional units, a communication unit 301, a parser processing unit 302, a user interface 304, and an operation unit 320. Each of communication unit 301, parser processing unit 302, user interface 304, and operation unit 320 can be implemented by computing device 35 executing parser program 365 stored in storage device 36.

Server device 32 performs a parser process to acquire operation data for operating air conditioner 10 from user device 70, convert the operation data into an operation command that can be recognized by air conditioner 10, and output the operation command to remote monitoring device 22. Remote monitoring device 22 outputs the operation command acquired from server device 32 to air conditioner 10 to remotely control air conditioner 10.

Specifically, the user inputs operation data for operating air conditioner 10 using user device 70. Server device 32 acquires the operation data from user device 70 through user interface 304. Operation unit 320 of server device 32 outputs the operation data acquired through user interface 304 to parser processing unit 302 and requests parser processing unit 302 to generate an operation command. Server device 32 converts the operation data into an operation command that can be recognized by air conditioner 10, using parser processing unit 302.

Here, FIG. 6 shows an example in which the operation data acquired from user device 70 includes "d_address" and "DataID_Drive". "d_address" indicates the destination address and, in this example, is associated with data "01" corresponding to the address of air conditioner 10. "DataID_Drive" indicates an operating status corresponding to ON or OFF and, in this example, is associated with data "01" corresponding to ON.

Upon acquiring operation data as described above, parser processing unit 302 converts the acquired operation data into an operation command that can be recognized by air conditioner 10.

For example, parser processing unit 302 associates "C9" indicating the address of server device 32 as the source address with the first byte of the operation command, associates "01" indicating the address of air conditioner 10 as the destination address with the second byte of the operation command, associates "03" as the command length with the third byte of the operation command, associates "0D01" indicating start/stop operation as the command kind with the fourth byte and the fifth byte of the operation command, and associates "01" indicating ON as the command content with the sixth byte of the operation command.

Upon generating an operation command based on the operation data as described above, parser processing unit 302 outputs the operation command to remote monitoring device 22. Remote monitoring device 22 acquires the operation command output from server device 32 through communication unit 201. Remote monitoring device 22 outputs the operation command to air conditioner 10 through air conditioning communication management unit 202. The operation command output to air conditioner 10 is indicated in a data format that can be recognized by air conditioner 10, using parser processing unit 302. With this configuration, air conditioner 10 operates in accordance with the user's instruction, based on the operation command.

FIG. 7 is a flowchart showing a process of air conditioning system 2 according to the second embodiment. Among the process steps shown in FIG. 7, a process performed by server device 32 can be implemented by computing device 35 executing parser program 365. A process performed by remote monitoring device 22 can be implemented by computing device 25 executing monitoring program 265.

As shown in FIG. 7, user device 70 outputs operation data for operating air conditioner 10 input by the user to server device 32 (S721). Server device 32 acquires the operation data output from user device 70 (S321). Server device 32 converts the operation data into an operation command, using parser processing unit 302 (S322). Server device 32 outputs the operation command to remote monitoring device 22 (S323).

Remote monitoring device 22 acquires the operation command output from server device 32 (S221). Remote monitoring device 22 outputs the operation command to air conditioner 10 (S222). Air conditioner 10 acquires the operation command output from remote monitoring device 22 (S121). Air conditioner 10 operates based on the operation command (S122).

In this way, in air conditioning system 2 according to the second embodiment, server device 32 converts the operation data input by the user into an operation command that can be recognized by air conditioner 10. Thus, remote monitoring device 22 can output the operation command acquired from server device 32 to air conditioner 10 as it is without converting the operation data input by the user into an operation command.

FIG. 6 explained above shows an example in which the user instructs air conditioner 10 to turn ON or OFF. However, in a case where a new function is added to air conditioner 10 or a new air conditioner 10 with a new function is connected to remote monitoring device 22, even when the user inputs operation data corresponding to the new function (for example, a setting value for a new high fan speed mode), server device 32 can convert the operation data input by the user into an operation command that can be recognized by air conditioner 10.

With this configuration, in a case where a new function is added to air conditioner 10 or a new air conditioner 10 with a new function is connected to remote monitoring device 22, even when the user inputs operation data corresponding to the new function, remote monitoring device 22 only needs to output the operation command acquired from server device 32 as it is to air conditioner 10. As a result, even when a new function is added to air conditioner 10 or when a new air conditioner 10 with a new function is connected to remote monitoring device 22, the user does not have to update remote monitoring device 22 and can allow air conditioner 10 to perform the operation corresponding to the new function only by updating server device 32. Air conditioning system 2 according to the second embodiment therefore does not impose a burden of updating air conditioner 10 and remote monitoring device 22 on the users.

In air conditioning system 2 above, an example in which the operation data for operating air conditioner 10 includes data for turning air conditioner 10 ON or OFF has been described. However, the operation data may include other data. For example, the operation data may include data for changing a setting temperature, data for changing a setting humidity, and data for switching the operation mode of cooling or heating.

Further, the operation data may include data for resetting abnormality of air conditioner 10. For example, user device 70 outputs to server device 32 operation data including an address for specifying air conditioner 10 for which abnormality is to be reset and data to reset abnormality, based on the user's input. Server device 32 converts the operation data into an operation command using parser processing unit 302 and outputs the operation command to remote monitoring device 22. Remote monitoring device 22 outputs the operation command from server device 32 to air conditioner 10 addressed by the operation data. Air conditioner 10 resets the abnormality based on the operation command.

The operation data may further include data for allowing any given air conditioner 10 to transmit air conditioning data of the air conditioner 10. As described above, the air conditioning data includes data such as an operating status corresponding to ON or OFF, operation start time, operation end time, setting temperature, setting humidity, operation mode of cooling or heating, indoor temperature, indoor humidity, refrigerant temperature, and refrigerant pressure. These pieces of air conditioning data may be any data that enables the user to identify the presence/absence of abnormality.

For example, user device 70 outputs to server device 32 operation data including an address for specifying air conditioner 10 whose air conditioning data is to be acquired and data (DataID) for specifying air conditioning data to request, based on the user's input. Server device 32 converts the operation data into an operation command, using parser processing unit 302, and outputs the operation command to remote monitoring device 22. Remote monitoring device 22 outputs the operation command from server device 32 to air conditioner 10 addressed by the operation data. Air conditioner 10 outputs the air conditioning data specified by the operation data to server device 32 through remote monitoring device 22, based on the operation command. Subsequently, server device 32 stores the air conditioning data of air conditioner 10 acquired through remote monitoring device 22 into storage device 36, through a process similar to that of server device 31 according to the first embodiment. When air conditioner 10 enters an abnormal state, the operation is not performed until the abnormal state is reset. Conventionally, a service person needs to go to the site and directly inspect the abnormality of air conditioner 10 to reset the abnormality. However, in air conditioning system 2 according to the second embodiment, the user who is a service person can acquire air conditioning data of air conditioner 10 from a remote site and monitor the air conditioning data by inputting operation data from user device 70. The user then can identify the presence/absence of an abnormal state of air conditioner 10 and identify the cause of the abnormality.

Furthermore, in air conditioning system 2 according to the second embodiment, the user who is a service person can reset an abnormal state of air conditioner 10 even from a remote site by inputting operation data from user device 70. For example, the user can reset abnormality of air conditioner 10 by inputting operation data for restarting air conditioner 10 from a remote site from user device 70. Further, the user can input reset operation for eliminating the cause of failure of air conditioner 10 to air conditioner 10 by inputting operation data from user device 70. With this configuration, the user who is a service person no longer has to go to the site to directly inspect the abnormality of air conditioner 10 and reset the abnormality, thereby improving the maintenance efficiency of air conditioner 10.

Further, remote monitoring device 22 may be configured to store data exchanged with air conditioner 10 for a predetermined period of time (for example, a few days) using storage device 26. In this case, even when abnormality in communication with server device 32 occurs, remote monitoring device 22 can hold data acquired from air conditioner 10, such as air conditioning data, for a predetermined period of time. With this configuration, even when air conditioner 10 enters an abnormal state, the user can identify the cause of the abnormality in a period of time in which storage device 26 holds data.

Third Embodiment

Figure 8:
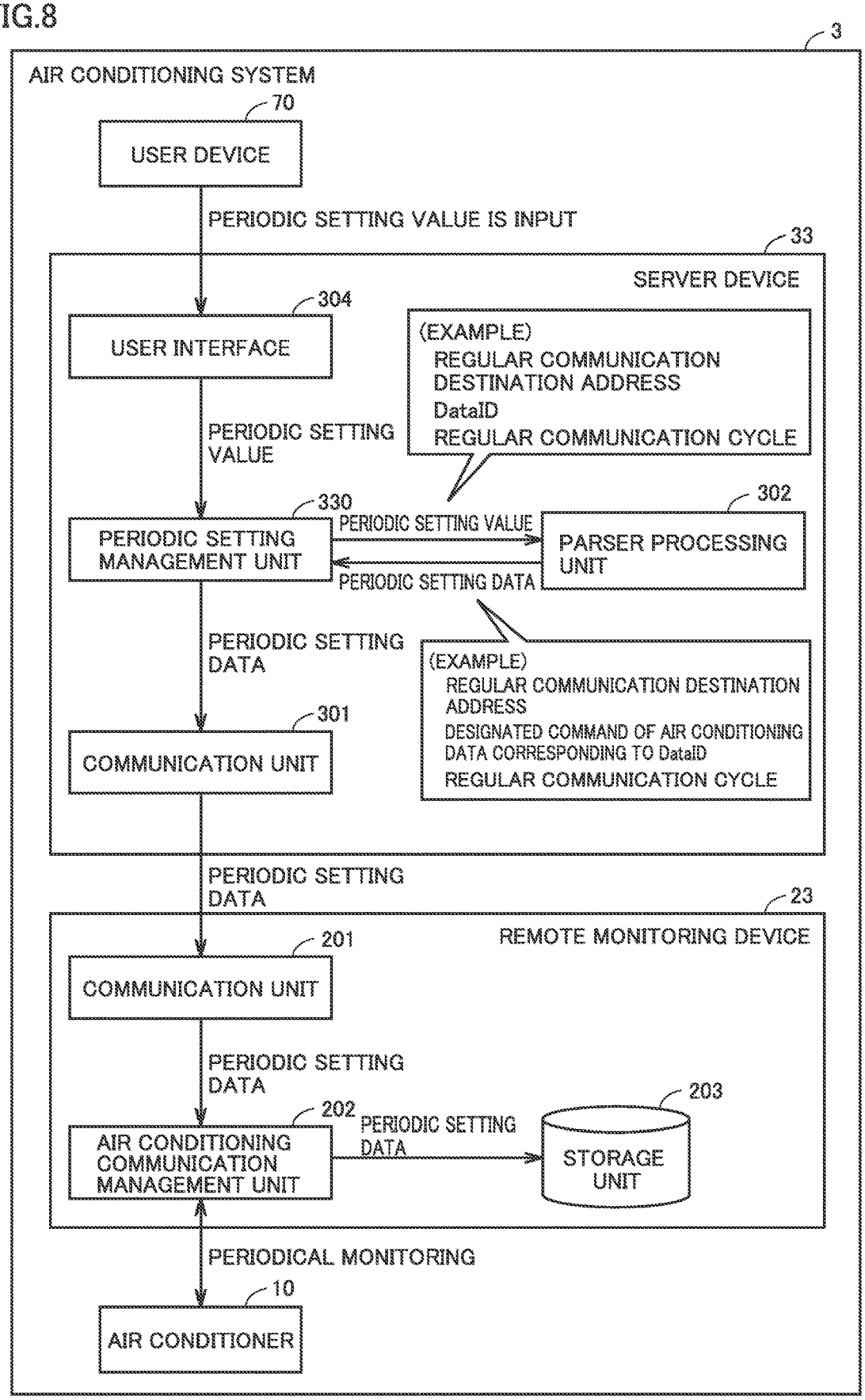
FIG. 8 is a diagram showing a functional configuration of an air conditioning system according to a third embodiment.
Figure 9:
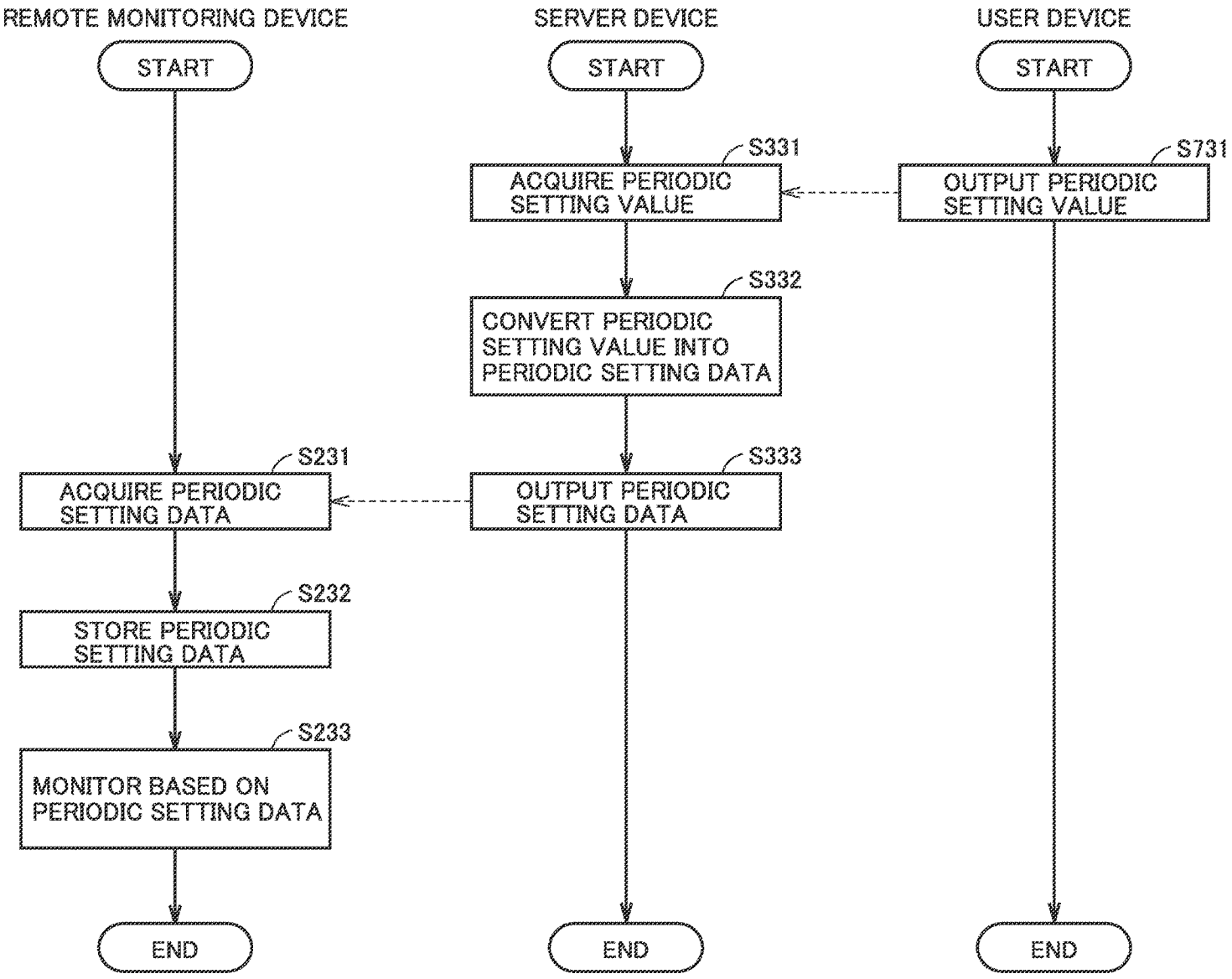
FIG. 9 is a flowchart showing a process of the air conditioning system according to the third embodiment.

Referring to FIG. 8 and FIG. 9, an air conditioning system 3 according to a third embodiment will be described. In the following, only the differences of air conditioning system 3 according to the third embodiment from air conditioning system 1 according to the first embodiment will be described.

FIG. 8 is a diagram showing a functional configuration of air conditioning system 3 according to the third embodiment. As shown in FIG. 8, air conditioning system 3 according to the third embodiment includes an air conditioner 10, a remote monitoring device 23, a server device 33, and a user device 70.

Remote monitoring device 23 according to the third embodiment includes a hardware configuration similar to that of remote monitoring device 21 according to the first embodiment and includes, as main functional units, a communication unit 201, an air conditioning communication management unit 202, and a storage unit 203. Each of communication unit 201 and air conditioning communication management unit 202 can be implemented by computing device 25 executing monitoring program 265 stored in storage device 26. Storage unit 203 is a functional unit corresponding to storage device 26.

Server device 33 according to the third embodiment includes a hardware configuration similar to that of server device 31 according to the first embodiment and includes, as main functional units, a communication unit 301, a parser processing unit 302, a user interface 304, and a periodic setting management unit 330. Each of communication unit 301, parser processing unit 302, user interface 304, and periodic setting management unit 330 can be implemented by computing device 35 executing a parser program 365 stored in storage device 36.

Server device 33 performs a parser process to acquire a periodic setting value for periodically monitoring air conditioner 10 from user device 70, convert the periodic setting value into periodic setting data that can be recognized by remote monitoring device 23, and output the periodic setting data to remote monitoring device 23. Remote monitoring device 23 stores the periodic setting data acquired from server device 33 into storage device 26. Remote monitoring device 23 then periodically monitors air conditioner 10 based on the periodic setting data.

Remote monitoring device 23 determines whether the air conditioning data stored in storage device 36 as illustrated in the example in FIG. 3 and FIG. 4 is the latest data by periodically monitoring air conditioner 10 based on the periodic setting data.

For example, as in the example in FIG. 3 and FIG. 4, remote monitoring device 23 can store air conditioning data into storage device 36 by outputting the air conditioning data acquired from air conditioner 10 to server device 33. However, for example, when communication abnormality occurs between air conditioner 10 and remote monitoring device 23, remote monitoring device 23 may be unable to acquire air conditioning data. Remote monitoring device 23 is therefore configured to actively acquire air conditioning data periodically from air conditioner 10 and output the acquired air conditioning data to server device 33 to keep the latest data for air conditioning data stored in storage device 36.

Specifically, the user inputs a periodic setting value for periodically monitoring air conditioner 10, using user device 70. Server device 33 acquires the periodic setting value from user device 70, through user interface 304. Periodic setting management unit 330 of server device 32 outputs the periodic setting value acquired through user interface 304 to parser processing unit 302 and requests parser processing unit 302 to generate periodic setting data. Server device 33 converts the periodic setting value into periodic setting data that can be recognized by remote monitoring device 23, using parser processing unit 302.

Here, FIG. 8 shows an example in which the periodic setting value acquired from user device 70 includes "regular communication destination address", "DataID", and "regular communication cycle". "Regular communication destination address" is the address of air conditioner 10 to be monitored by remote monitoring device 23. "DataID" indicates the content of monitoring by remote monitoring device 23, such as switching between ON and OFF, switching between cooling and heating, the setting of indoor temperature, and the setting of indoor humidity. "Regular communication cycle" indicates the monitoring cycle of remote monitoring device 23. In other words, the user can specify the address of air conditioner 10 to be monitored by remote monitoring device 23, the monitoring target of remote monitoring device 23, the monitoring content, and the monitoring cycle, as periodic setting values, using user device 70.

Upon acquiring the periodic setting value as described above, parser processing unit 302 converts the acquired periodic setting value into periodic setting data that can be recognized by remote monitoring device 23.

For example, parser processing unit 302 associates the user-specified data "regular communication destination address" with "regular communication destination address" of the periodic setting data. Parser processing unit 302 associates the user-specified data "DataID" with the designated command of air conditioning data of the periodic setting data. Remote monitoring device 23 can identify the monitoring content by referring to the designated command of air conditioning data. Parser processing unit 302 associates the user-specified data "regular communication cycle" with "regular communication cycle" of the periodic setting data.

Upon generating periodic setting data based on the periodic setting value as described above, parser processing unit 302 outputs the periodic setting data to remote monitoring device 23. Remote monitoring device 23 acquires the periodic setting data output from server device 33, through communication unit 201. Remote monitoring device 22 stores the periodic setting data acquired from server device 33 using storage unit 203. Remote monitoring device 23 periodically monitors air conditioner 10 based on the periodic setting data stored in storage unit 203, using air conditioning communication management unit 202.

FIG. 9 is a flowchart showing a process of air conditioning system 3 according to the third embodiment. Among the process steps shown in FIG. 9, a process performed by server device 33 can be implemented by computing device 35 executing parser program 365. A process performed by remote monitoring device 23 can be implemented by computing device 25 executing monitoring program 265.

As shown in FIG. 9, user device 70 outputs a periodic setting value for periodically monitoring air conditioner 10 that is input by the user to server device 33 (S731). Server device 33 acquires the periodic setting value output from user device 70 (S331). Server device 33 converts the periodic setting value into periodic setting data, using parser processing unit 302 (S332). Server device 33 outputs the periodic setting data to remote monitoring device 23 (S333).

Remote monitoring device 23 acquires the periodic setting data output from server device 33 (S231). Remote monitoring device 23 stores the periodic setting data into storage device 26 (S232). Remote monitoring device 23 monitors air conditioner 10 based on the periodic setting data stored in storage device 26 (S233).

In this way, in air conditioning system 3 according to the third embodiment, server device 33 converts the periodic setting value input by the user into periodic setting data that can be recognized by remote monitoring device 23. Thus, remote monitoring device 23 itself does not have to convert the periodic setting value input by the user into periodic setting data but can monitor air conditioner 10 based on the periodic setting data acquired from server device 33.

With this configuration, in a case where a new function is added to air conditioner 10 or a new air conditioner 10 with a new function is connected to remote monitoring device 23, even when the user inputs a periodic setting value corresponding to the new function, remote monitoring device 23 can monitor air conditioner 10 based on the periodic setting data acquired from server device 33. As a result, even when a new function is added to air conditioner 10 or when a new air conditioner 10 with a new function is connected to remote monitoring device 23, the user does not have to update remote monitoring device 23 and can monitor air conditioner 10 for the air conditioning data corresponding to the new function only by updating server device 33. Air conditioning system 3 according to the third embodiment therefore does not impose a burden of updating air conditioner 10 and remote monitoring device 23 on the users.

In air conditioning system 3, the user may input a periodic setting value from user device 70 so that remote monitoring device 23 acquires plural pieces of air conditioning data desired by the user collectively from air conditioner 10 and stores the acquired air conditioning data into storage device 26. With this configuration, the user such as a service operator who maintains air conditioner 10 can periodically acquire air conditioning data necessary for maintenance through remote monitoring device 23 by registering desired air conditioning data using a periodic setting value. In other words, unlike air conditioning system 2 according to the foregoing second embodiment, the user does not have to acquire desired air conditioning data using operation data each time and can periodically acquire air conditioning data necessary for maintenance once the periodic setting value is registered.

In general, in a cloud service, as the volume of processing by a cloud server such as server device 33 increases, the usage fee for the cloud server increases, so there is a demand for reducing the volume of processing by the cloud server. For example, if air conditioning data is monitored each time using operation data via server device 33 on cloud as in air conditioning system 2 according to the foregoing second embodiment, the volume of processing by server device 33 increases, and the usage fee for server device 33 increases accordingly. In this respect, if desired air conditioning data is registered once a periodic setting value is set, as in air conditioning system 3 according to the third embodiment, the volume of processing for periodic monitoring via server device 33 can be reduced, and the cloud usage fee can be reduced.

Fourth Embodiment

Referring to FIG. 10 to FIG. 13, an air conditioning system 4 according to a fourth embodiment will be described. In the following, only the differences of air conditioning system 4 according to the fourth embodiment from air conditioning system 1 according to the first embodiment will be described.

Figure 10:
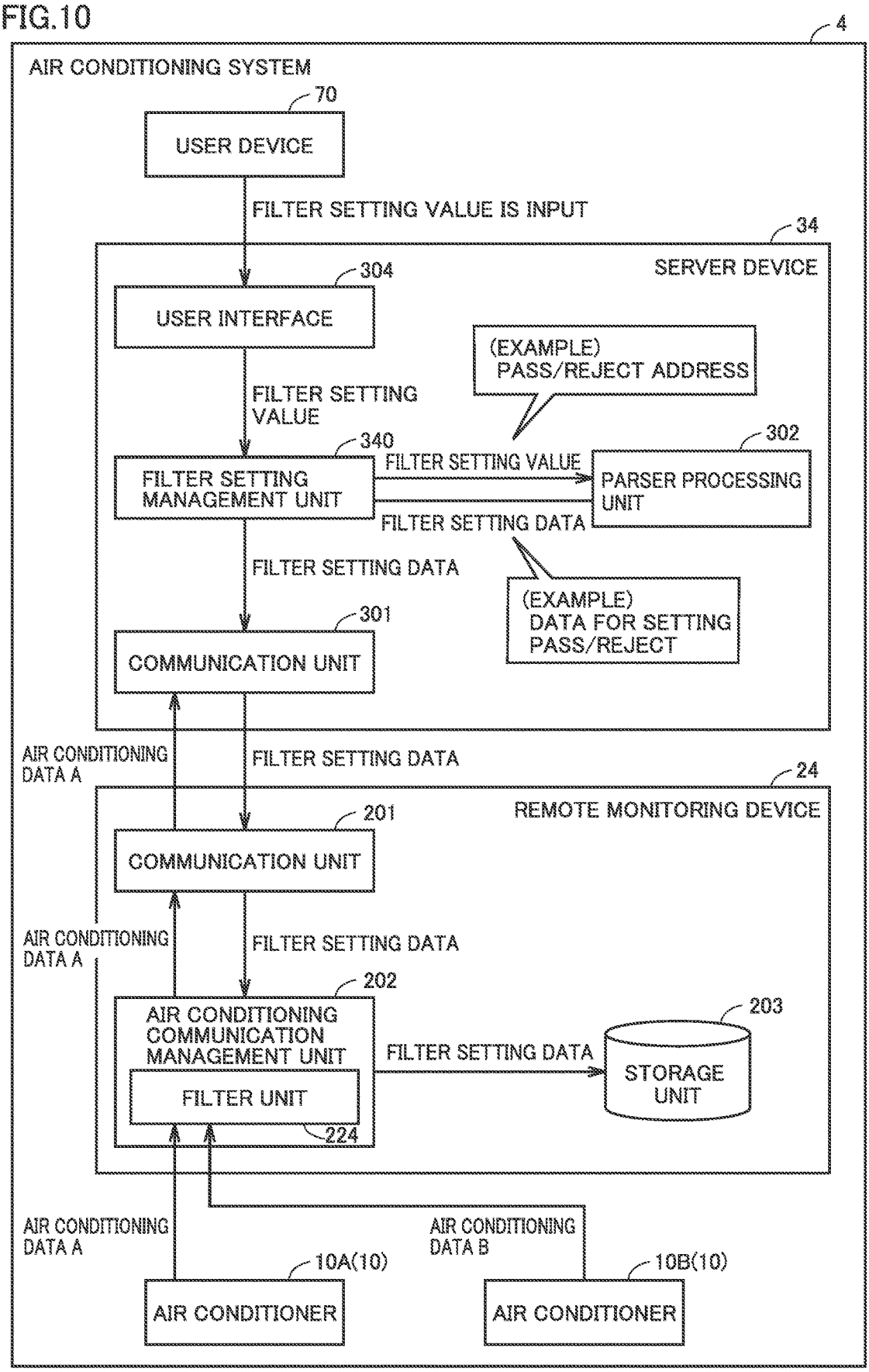
FIG. 10 is a diagram showing a functional configuration of an air conditioning system according to a fourth embodiment.

FIG. 10 is a diagram showing a functional configuration of air conditioning system 4 according to the fourth embodiment. As shown in FIG. 10, air conditioning system 4 according to the fourth embodiment includes a plurality of air conditioners 10 (10A, 10B), a remote monitoring device 24, a server device 34, and a user device 70.

Remote monitoring device 24 according to the fourth embodiment includes a hardware configuration similar to that of remote monitoring device 21 according to the first embodiment and includes, as main functional units, a communication unit 201, an air conditioning communication management unit 202, and a storage unit 203. Each of communication unit 201 and air conditioning communication management unit 202 can be implemented by computing device 25 executing monitoring program 265 stored in storage device 26. Storage unit 203 is a functional unit corresponding to storage device 26.

Server device 34 according to the fourth embodiment includes a hardware configuration similar to that of server device 31 according to the first embodiment and includes, as main functional units, a communication unit 301, a parser processing unit 302, a user interface 304, and a filter setting management unit 340. Each of communication unit 301, parser processing unit 302, user interface 304, and filter setting management unit 340 can be implemented by computing device 35 executing parser program 365 stored in storage device 36.

Server device 34 performs a parser process to acquire, from user device 70, a filter setting value for filtering air conditioning data output from air conditioner 10, convert the filter setting value into filter setting data that can be recognized by remote monitoring device 24, and output the filter setting data to remote monitoring device 24. Remote monitoring device 24 stores the filter setting data acquired from server device 34 into storage device 26. Remote monitoring device 24 then filters the air conditioning data acquired from air conditioner 10 based on the filter setting data.

In the example in FIG. 10, remote monitoring device 24 acquires only the air conditioning data of air conditioner 10 required by the user, by acquiring the air conditioning data of air conditioner 10 permitted by the filter setting data among a plurality of air conditioners 10 (10A, 10B) under monitoring, and stores the acquired air conditioning data into storage device 36.

For example, as in the example in FIG. 3 and FIG. 4, remote monitoring device 24 can store the air conditioning data into storage device 36 by outputting the air conditioning data acquired from air conditioner 10 to server device 34. However, if remote monitoring device 24 acquires and outputs all air conditioning data output from a plurality of air conditioners 10 to server device 34, the communication volume increases and the storage capacity of storage device 36 may become insufficient. Remote monitoring device 24 is therefore configured to filter air conditioning data that can be acquired from each of a plurality of air conditioners 10 and acquire only the air conditioning data required by the user, thereby suppressing the volume of air conditioning data stored by storage device 36 while suppressing the communication volume.

Figure 11:
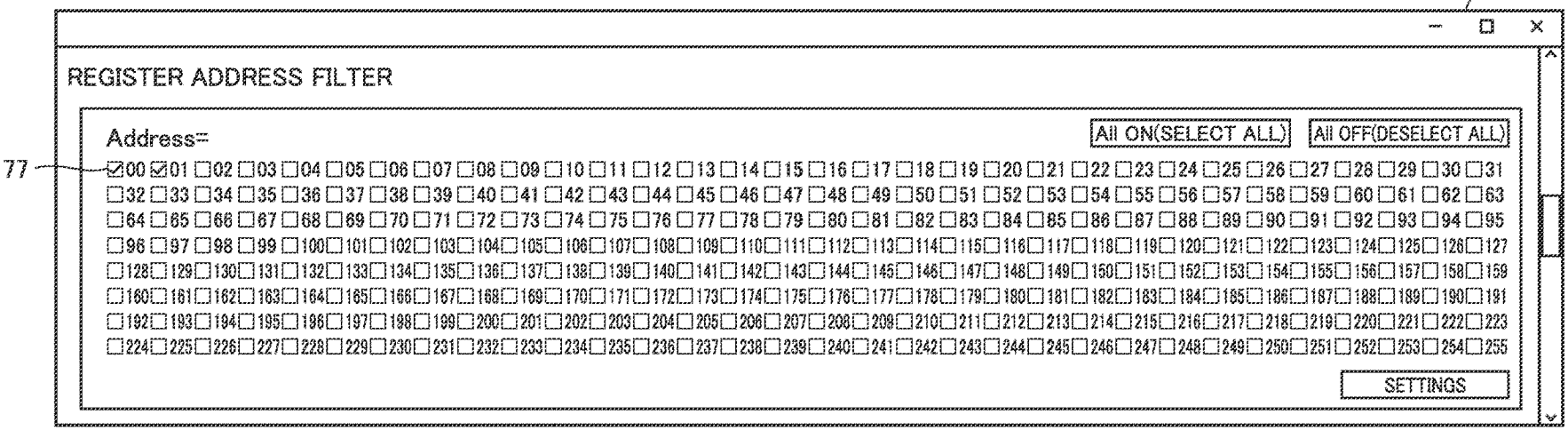
FIG. 11 is a diagram for explaining input of filter setting values in the air conditioning system according to the fourth embodiment.

Specifically, the user inputs a filter setting value for filtering the air conditioning data output from each of a plurality of air conditioners 10, using user device 70. Here, FIG. 11 is a diagram for explaining input of filter setting values in air conditioning system 4 according to the fourth embodiment. As shown in FIG. 11, a plurality of check boxes 77 each for selecting the address of air conditioner 10 whose air conditioning data is permitted to be acquired appear on a display 75 of user device 70. The user places a check mark in check box 77 with the address corresponding to air conditioner 10 from which the user desires to acquire air conditioning data to acquire air conditioning data only from the desired air conditioner 10 and store the acquired air conditioning data into storage device 36. In other words, the filter setting value includes information on the address of at least one air conditioner 10 whose air conditioning data is permitted to be acquired, among a plurality of air conditioners 10 under monitoring.

Returning to FIG. 10, server device 34 acquires a filter setting value from user device 70 through user interface 304. Filter setting management unit 340 of server device 34 outputs the filter setting value acquired through user interface 304 to parser processing unit 302 and requests parser processing unit 302 to generate filter setting data. Server device 34 converts the filter setting value into filter setting data that can be recognized by remote monitoring device 24, using parser processing unit 302.

Here, FIG. 10 shows an example in which the filter setting value acquired from user device 70 includes the address of air conditioner 10 corresponding to "pass" or "reject". In check box 77 shown in FIG. 11, air conditioner 10 corresponding to the address to which the user places a check mark is associated with "pass" in the filter setting value, and air conditioner 10 corresponding to the address to which the user does not place a check mark is associated with "reject" in the filter setting value.

Upon acquiring the filter setting value as described above, parser processing unit 302 converts the acquired filter setting value into filter setting data that can be recognized by remote monitoring device 24. For example, parser processing unit 302 generates filter setting data by associating "pass" or "reject" for each of the addresses of a plurality of air conditioners 10 in a data format that can be recognized by remote monitoring device 24, based on the filter setting value.

Upon generating filter setting data based on the filter setting value, parser processing unit 302 outputs the filter setting data to remote monitoring device 24. Remote monitoring device 24 acquires the filter setting data output from server device 34, through communication unit 201. Remote monitoring device 24 stores the filter setting data acquired from server device 34, using storage unit 203. Remote monitoring device 24 then updates a filter table (now shown) for filtering based on the filter setting data.

Air conditioning communication management unit 202 includes a filter unit 224. Remote monitoring device 24 acquires air conditioning data only from air conditioner 10 corresponding to the address set to "pass", based on the filter setting data stored in storage unit 203, using filter unit 224, and outputs the acquired air conditioning data to server device 34. More specifically, remote monitoring device 24 does not have the function of switching "pass" and "reject" (that is, enabling or disabling filtering) for each address and filters air conditioning data based on the filter table, when acquiring air conditioning data from air conditioner 10. In this way, remote monitoring device 24 applies filter setting by updating the filter table based on the filter setting data.

FIG. 10 shows an example in which the filter is applied to a predetermined address, and filter unit 224 compares the address of air conditioner 10 with the address set to "reject" by the filter setting data (filter table). In the filter setting data, each address is associated in advance with any bit belonging to a predetermined range (for example, 0 to 255), and filter unit 224 outputs only the air conditioning data from air conditioner 10 having the address associated with "1" to server device 34.

For example, in the example in FIG. 10, remote monitoring device 24 does not acquire air conditioning data B from air conditioner 10B corresponding to the address set to "reject", but acquires air conditioning data A from air conditioner 10A corresponding to the address set to "pass" and outputs the acquired air conditioning data A to server device 34. In this way, remote monitoring device 24 can output air conditioning data only from air conditioner 10 permitted by the user and output the acquired air conditioning data to server device 34.

In FIG. 10, an example in which remote monitoring device 24 acquires air conditioning data of air conditioner 10 permitted by the filter setting data, among a plurality of air conditioners 10 under monitoring. However, remote monitoring device 24 may filter air conditioning data by other methods.

Figure 12:
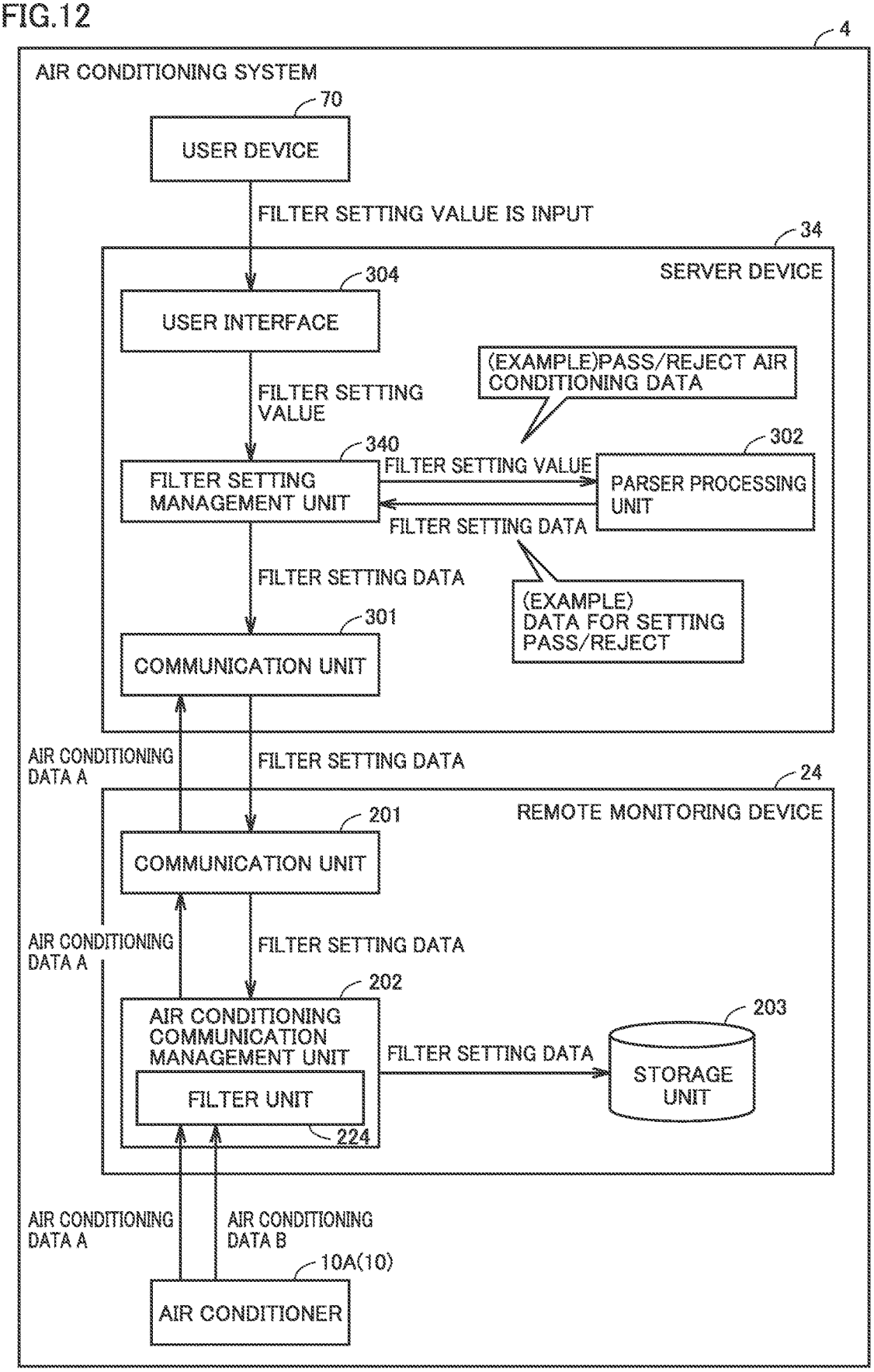
FIG. 12 is a diagram showing a functional configuration of the air conditioning system according to a modification of the fourth embodiment.

FIG. 12 is a diagram showing a functional configuration of air conditioning system 4 according to a modification of the fourth embodiment. In the example in FIG. 12, remote monitoring device 24 acquires only air conditioning data required by the user by acquiring air conditioning data permitted by the filter setting data, among plural pieces of air conditioning data in at least one air conditioner 10, and stores the acquired air conditioning data into storage device 36.

Specifically, the user sets air conditioning data to be permitted to be acquired, using a filter setting value, among plural pieces of air conditioning data that can be output from at least one air conditioner 10 under monitoring. For example, the user sets air conditioning data to be permitted to be acquired, using a filter setting value, among various kinds of air conditioning data, such as operating status, operation start time, operation end time, setting temperature, setting humidity, operation mode of cooling or heating, indoor temperature, and indoor humidity. In other words, the filter setting value includes information of air conditioning data to be permitted to be acquired, among plural pieces of air conditioning data that can be output from at least one air conditioner 10 under monitoring.

Here, FIG. 12 shows an example in which the filter setting value acquired from user device 70 includes information of air conditioning data corresponding to "pass" or "reject". The air conditioning data that the user permits to acquire is associated with "pass" in the filter setting value, and the air conditioning data that the user does not permit to acquire is associated with "reject" in the filter setting value.

Upon acquiring the filter setting value as described above, parser processing unit 302 converts the acquired filter setting value into filter setting data that can be recognized by remote monitoring device 24. For example, parser processing unit 302 generates filter setting data for setting "pass" or "reject" for each of plural pieces of air conditioning data in a data format that can be recognized by remote monitoring device 24, based on the filter setting value.

Upon generating filter setting data based on the filter setting value, parser processing unit 302 outputs the filter setting data to remote monitoring device 24. Remote monitoring device 24 acquires the filter setting data output from server device 34, through communication unit 201. Remote monitoring device 24 stores the filter setting data acquired from server device 34, using storage unit 203. Remote monitoring device 24 then updates a filter table (now shown) for filtering based on the filter setting data.

Remote monitoring device 24 acquires only the air conditioner data set to "pass", based on the filter setting data stored in storage unit 203, using filter unit 224, and outputs the acquired air conditioning data to server device 34. More specifically, remote monitoring device 24 does not have the function of switching "pass" and "reject" (that is, enabling or disabling filtering) for each piece of air conditioning data and filters air conditioning data based on the filter table, when acquiring air conditioning data from air conditioner 10. In this way, remote monitoring device 24 applies filter setting by updating the filter table based on the filter setting data.

FIG. 12 shows an example in which the filter is applied to predetermined air conditioning data, and filter unit 224 compares the air conditioning data with the air conditioning data set to "reject" by the filter setting data (filter table). In the filter setting data, each piece of air conditioning data is associated in advance with any bit belonging to a predetermined range (for example, 0 to 255), and filter unit 224 outputs only the air conditioning data associated with "1" to server device 34.

For example, in the example in FIG. 12, remote monitoring device 24 does not acquire air conditioning data B set to "reject", among air conditioning data that can be output from air conditioner 10A, but acquires air conditioning data A set to "pass" and outputs the acquired air conditioning data A to server device 34. In this way, remote monitoring device 24 can acquire only the air conditioning data permitted by the user and output the acquired air conditioning data to server device 34.

Among the data filtered by the filter setting data, data related to an operating status of air conditioner 10 is stored in storage unit 203 of remote monitoring device 24. The data related to an operating status of air conditioner 10 held by remote monitoring device 24 is used so that ON/OFF or abnormal state of air conditioner 10 is reflected in a lighting unit (for example, light-emitting diode (LED)) of remote monitoring device 24. In other words, among air conditioning data, data indicated by the lighting unit of remote monitoring device 24 is stored into storage unit 203 by remote monitoring device 24 but is not output to server device 34, irrespective of whether it is filtered by the filter setting data.

Figure 13:
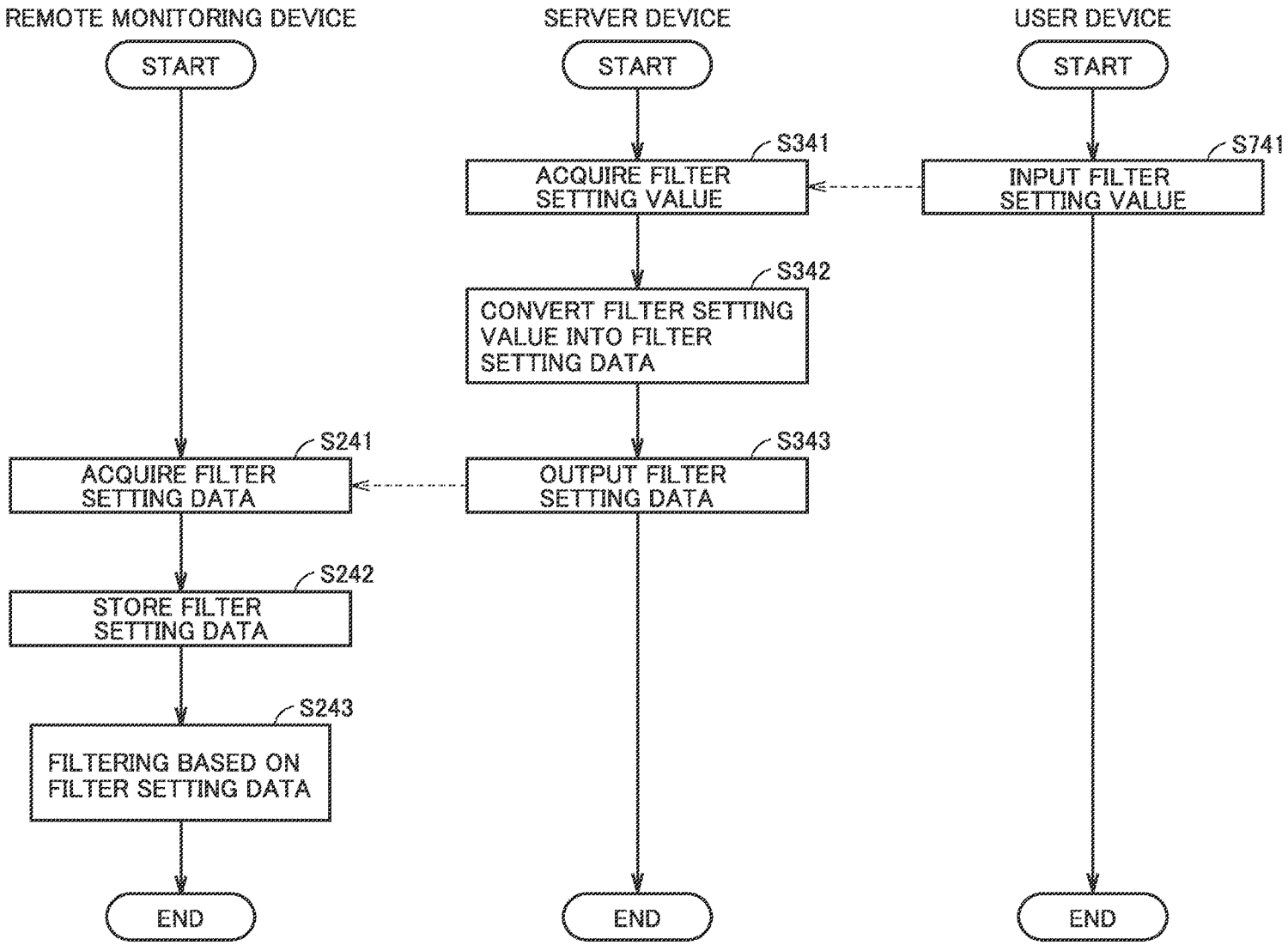
FIG. 13 is a flowchart showing a process of the air conditioning system according to the fourth embodiment.

FIG. 13 is a flowchart showing a process of air conditioning system 4 according to the fourth embodiment. Among the process steps shown in FIG. 13, a process performed by server device 34 can be implemented by computing device 35 executing parser program 365. A process performed by remote monitoring device 24 can be implemented by computing device 25 executing monitoring program 265.

As shown in FIG. 13, user device 70 outputs a filter setting value for filtering air conditioning data input by the user to server device 34 (S741). Server device 34 acquires the filter setting value output from user device 70 (S341). Server device 34 converts the filter setting value into filter setting data, using parser processing unit 302 (S342). Server device 34 outputs the filter setting data to remote monitoring device 24 (S343).

Remote monitoring device 24 acquires the filter setting data output from server device 34 (S241). Remote monitoring device 24 stores the filter setting data into storage device 26 (S242). Remote monitoring device 24 filters air conditioning data based on the filter setting data stored in storage device 26 and acquires only the permitted air conditioning data (S243).

In this way, in air conditioning system 4 according to the fourth embodiment, server device 34 converts the filter setting value input by the user into filter setting data that can be recognized by remote monitoring device 24. Thus, remote monitoring device 24 itself does not have to convert the filter setting value input by the user into filter setting data but can filter air conditioning data based on the filter setting data acquired from server device 34.

With this configuration, in a case where a new function is added to air conditioner 10 or a new air conditioner 10 with a new function is connected to remote monitoring device 24, even when the user inputs a filter setting value corresponding to the new function, remote monitoring device 24 can filter air conditioning data based on the filter setting data acquired from server device 34. As a result, even when a new function is added to air conditioner 10 or when a new air conditioner 10 with a new function is connected to remote monitoring device 24, the user does not have to update remote monitoring device 24 and can filter air conditioning data corresponding to the new function only by updating server device 34. Air conditioning system 4 according to the fourth embodiment therefore does not impose a burden of updating air conditioner 10 and remote monitoring device 24 on the users.

An example of air conditioning data that is likely to be filtered by filter setting data is maintenance data. The maintenance data is data for the remote monitoring device to monitor an operating status in more detail for air conditioner 10. For example, the maintenance data includes data mainly used for maintenance, such as pressure value, temperature value, and power consumption value measured by sensors or the like installed in air conditioner 10. The user can apply a filter to these pieces of data by inputting a filter setting value when detailed data such as pressure value and current value is not necessary.

Data related to a function that is installed in some air conditioners 10 but not supported by a user interface screen of user device 70, such as humidity setting and left/right fan direction, is unable to be displayed or operated even when acquired by the user. Thus, such data that is not supported by the user interface screen may be a target to be filtered. The remote monitoring device may automatically set a filter for data that can be supported by the user interface screen, among the acquired air conditioning data.

Further, when air conditioner 10 that is not a monitoring target by the remote monitoring device or the remote controller of the air conditioner 10 is connected to the remote monitoring device, air conditioning data from such air conditioner 10 that is not a monitoring target may be a target to be filtered. The remote monitoring device may determine whether air conditioner 10 is not a monitoring target, based on information acquired in initial communication, and may update the filter table based on the result.

In the air conditioning system according to each of the foregoing first to fourth embodiments, operation data, a periodic setting value, or a filter setting value can be input by the user as described below. Specifically, user device 70 accesses the UI (not shown) of the server device through user interface 304 of the server device. The user first inputs identification information (for example, product number) of the remote monitoring device from user device 70 to register the identification information in the UI. User device 70 graphically displays a screen including information on air conditioner 10 acquired by the remote monitoring device corresponding to the identification information registered in the UI. In the displayed screen, the user inputs various setting data (operation data, periodic setting value, or filter setting value) of the remote monitoring device. Parser processing unit 302 of the server device converts various setting data input through user device 70 into a format readable by the remote monitoring device and outputs the converted data to the remote monitoring device through communication unit 301.

In the air conditioning system, various setting data (operation data, periodic setting value, or filter setting value) may be registered directly in the remote monitoring device. For example, in initial shipment of the air conditioning system and the remote monitoring device, various setting data may be registered in a nonvolatile region of the remote monitoring device.

Further, the user may input various setting data directly from the remote monitoring device as described below.

Specifically, the remote monitoring device may allow the user to set the same contents as those of a remote controller for operating air conditioner 10 (for example, ON or OFF, operation start time, operation end time, setting temperature, setting humidity, operation mode of cooling or heating, indoor temperature, indoor humidity) as operation data.

The remote monitoring device can register a predetermine number (for example, 1000) of combinations of "DataID", "regular communication destination address", and "regular communication cycle" as periodic setting values. When the user has additional air conditioning data that the user wishes to monitor, the user can freely set "DataID", "regular communication destination address", and "regular communication cycle" from the remote monitoring device. Further, the remote monitoring device may prepare a set of combinations of "DataID", "regular communication destination address", and "regular communication cycle" in the form of a template in accordance with the purpose or application of monitoring and allow the user to select it to easily perform periodic setting.

For filter setting, the remote monitoring device may be configured to display which air conditioner 10 is connected to which address, based on information on air conditioner 10 acquired in initial communication, and allow the user to filter an unnecessary air conditioner 10, if desired. Alternatively, when an air conditioner 10 that is not supported by the remote monitoring device is connected, the remote monitoring device may set a filter for the air conditioner 10, based on information on air conditioner 10 collected in initial communication.

For filter setting, the remote monitoring device may be configured to display what functions air conditioner 10 have in the form of a list, based on information on air conditioner 10 acquired in initial communication, and allow the user to filter data other than data related to desired functions. Alternatively, the remote monitoring device may prepare a set of setting contents of filtering in the form of a template, in accordance with the purpose or application of monitoring, and allow the user to select it to easily perform filtering.

SUMMARY

The present disclosure relates to air conditioning systems 1 to 4. Air conditioning systems 1 to 4 include air conditioner 10, remote monitoring devices 21 to 24 to monitor air conditioner 10, and server devices 31 to 34 to communicate with remote monitoring devices 21 to 24. Server devices 31 to 34 include communication unit 301 to transmit/receive data to/from remote monitoring devices 21 to 24, and parser processing unit 302 to perform a process related to monitoring of air conditioner 10 by remote monitoring devices 21 to 24.

With this configuration, air conditioning systems 1 to 4 can update a process related to monitoring of air conditioner 10 by remote monitoring devices 21 to 24 by updating server devices 31 to 34 rather than air conditioner 10 and remote monitoring devices 21 to 24, and therefore do not impose a burden of updating air conditioner 10 and remote monitoring devices 21 to 24 on users.

As shown in FIG. 3 to FIG. 5, in air conditioning system 1 according to the first embodiment, server device 31 further includes storage device 36. Remote monitoring device 21 acquires air conditioning data related to air conditioning of air conditioner 10 and outputs the air conditioning data to server device 31. Server device 31 analyzes the air conditioning data acquired from remote monitoring device 21 using parser processing unit 302 and stores the analysis result of the air conditioning data into storage device 36.

With this configuration, even when a new function is added to air conditioner 10 or when a new air conditioner 10 with a new function is connected to remote monitoring device 21, the user does not have to update remote monitoring device 21 and can store data corresponding to the new function into storage device 36 only by updating server device 31.

As shown in FIG. 6 and FIG. 7, in air conditioning system 2 according to the second embodiment, server device 32 acquires operation data for operating air conditioner 10 from the user, converts the operation data into an operation command that can be recognized by air conditioner 10, using parser processing unit 302, and outputs the operation command to remote monitoring device 22. Remote monitoring device 22 outputs the operation command acquired from server device 32 to air conditioner 10.

With this configuration, even when a new function is added to air conditioner 10 or when a new air conditioner 10 with a new function is connected to remote monitoring device 22, the user does not have to update remote monitoring device 22 and can allow air conditioner 10 to perform the operation corresponding to the new function only by updating server device 32.

As shown in FIG. 8 and FIG. 9, in air conditioning system 3 according to the third embodiment, server device 33 acquires a periodic setting value for periodically monitoring air conditioner 10 from the user, converts the periodic setting value into periodic setting data that can be recognized by remote monitoring device 23, using parser processing unit 302, and outputs the periodic setting data to remote monitoring device 23. Remote monitoring device 23 periodically monitors air conditioner 10, based on the periodic setting data acquired from server device 33.

With this configuration, even when a new function is added to air conditioner 10 or when a new air conditioner 10 with a new function is connected to remote monitoring device 23, the user does not have to update remote monitoring device 23 and can monitor air conditioner 10 for the air conditioning data corresponding to the new function only by updating server device 33.

As shown in FIG. 10 to FIG. 13, in air conditioning system 4 according to the fourth embodiment, server device 34 acquires a filter setting value for filtering air conditioning data related to air conditioning of air conditioner 10 from the user, converts the filter setting value into filter setting data that can be recognized by remote monitoring device 24, using parser processing unit 302, and outputs the filter setting data to remote monitoring device 24. Remote monitoring device 24 filters the air conditioning data acquired from air conditioner 10 based on the filter setting data acquired from server device 34.

With this configuration, even when a new function is added to air conditioner 10 or when a new air conditioner 10 with a new function is connected to remote monitoring device 24, the user does not have to update remote monitoring device 24 and can filter air conditioning data corresponding to the new function only by updating server device 34.

As shown in FIG. 10, in air conditioning system 4 according to the fourth embodiment, remote monitoring device 24 acquires air conditioning data of air conditioner 10 permitted by the filter setting data, among a plurality of air conditioners 10 under monitoring.

With this configuration, the user can acquire only air conditioning data required by the user, among air conditioning data that can be acquired from a plurality of air conditioners 10, thereby suppressing the volume of air conditioning data stored by storage device 36 while suppressing the communication volume.

As shown in FIG. 12, in air conditioning system 4 according to the fourth embodiment, remote monitoring device 24 acquires air conditioning data permitted by the filter setting data, among plural pieces of air conditioning data.

With this configuration, the user can acquire only air conditioning data required by the user, among plural pieces of air conditioning data in at least one air conditioner 10, thereby suppressing the volume of air conditioning data stored by storage device 36 while suppressing the communication volume.

Although the air conditioning systems according to the first to fourth embodiments have been described above, the configurations and functions of the air conditioning systems may be combined. For example, one air conditioning system may include all of the configurations and functions of the air conditioning systems according to the first to fourth embodiments.

Embodiments disclosed here should be understood as being illustrative rather than being limitative in all respects. The scope of the present disclosure is shown not in the description of embodiments described above but in the claims, and it is intended that all modifications that come within the meaning and range of equivalence to the claims are embraced here.

REFERENCE SIGNS LIST

1, 2, 3, 4 air conditioning system, 10, 10A, 10B air conditioner, 21, 22, 23, 24 remote monitoring device, 25, 35 computing device, 26, 36 storage device, 27, 37 communication device, 31, 32, 33, 34 server device, 40A, 40B outdoor unit, 51A, 51B, 52A, 52B indoor unit, 60A, 60B remote controller, 70 user device, 75 display, 77 check box, 80 router, 90A, 90B network, 201, 301 communication unit, 202 air conditioning communication management unit, 203, 303 storage unit, 224 filter unit, 265 monitoring program, 302 parser processing unit, 304 user interface, 310 data analysis unit, 320 operation unit, 330 periodic setting management unit, 340 filter setting management unit, 365 parser program.

The invention claimed is:

1. An air conditioning system comprising:

an air conditioner;

a remote monitor comprising a monitor processor or circuit configured to monitor the air conditioner; and a server comprising a server processor or circuit configured to communicate with the remote monitor, transmit and receive data to and from the remote monitoring device-monitor, and perform a parser process related to monitoring of the air conditioner by the remote monitor, wherein the server processor or circuit is further configured to acquire a filter setting value for filtering air conditioning data related to air conditioning of the air conditioner from a user, convert the filter setting value into filter setting data recognizable by the remote monitor, using the parser process, and output the filter setting data to the remote monitor, and the monitor processor or circuit is further configured to update a filter table for filtering the air conditioning data, based on the filter setting data acquired from the server, filter the air conditioning data acquired from the air conditioner, based on the filter table which is updated, and acquire the air conditioning data permitted by the filter setting data, among plural pieces of the air conditioning data.

2. The air conditioning system according to claim 1, wherein the server further comprises a storage, the monitor processor or circuit is further configured to acquire air conditioning data related to air conditioning of the air conditioner and output the air conditioning data to the server, and the server processor or circuit is further configured to analyze the air conditioning data acquired from the remote monitor using the parser process that parses the air conditioning data and store an analysis result of the air conditioning data into the storage.

3. The air conditioning system according to claim 1, wherein the server processor or circuit is further configured to acquire operation data for operating the air conditioner from the user, convert the operation data into an operation command recognizable by the air conditioner, using the parser process that parses the air conditioning data, and output the operation command to the remote monitor, and the monitor processor or circuit is further configured to output the operation command acquired from the server to the air conditioner.

4. The air conditioning system according to claim 1, wherein the server processor or circuit is further configured to acquire a periodic setting value for periodically monitoring the air conditioner from the user, convert the periodic setting value into periodic setting data recognizable by the remote monitor, using the parser process that parses the air conditioning data, and output the periodic setting data to the remote monitor, and the monitor processor or circuit is further configured to periodically monitor the air conditioner based on the periodic setting data acquired from the server.

5. The air conditioning system according to claim 1, wherein the monitor processor or circuit is further configured to acquire acquires the air conditioning data of the air conditioner permitted by the filter setting data, among a plurality of the air conditioners under monitoring.

6. The air conditioning system according to claim 1, wherein the parser process that parses the air conditioning data performs, as a process related to monitoring of the air conditioner, at least one of a process to analyze data acquired from the remote monitor, a process to convert data for operating the air conditioner into a command recognizable by the remote monitor, and a process to convert a setting value for monitoring the air conditioner into data recognizable by the remote monitor.

7. The air conditioning system according to claim 1, wherein the monitor processor or circuit is configured to transmit and receive air conditioning data to and from the air conditioner via a first wired or wireless communication line, transmit and receive the air conditioning data to and from the server via a second wired or wireless communication line, wherein the air conditioning data received from the air conditioner is transmitted as it is to the server, and wherein the air conditioning data received from the server is transmitted as it is to the air conditioner, and the server processor or circuit is configured to transmit and receive the air conditioning data to and from the remote monitor via the second wired or wireless communication line, wherein, at the server processor or circuit, the parser process related to monitoring of the air conditioner parses the air conditioning data which is received from the remote monitor assuming that the air conditioning data as it is from the air conditioner, and analyzes the parsed air conditioning data.

8. The air conditioning system according to claim 1, wherein at the server processor or circuit, the parser process related to monitoring of the air conditioner:

parses the air conditioning data which is received from the monitor processor or circuit assuming that the air conditioning data is as received by the monitor processor or circuit from the air conditioner, and analyzes the parsed air conditioning data.

9. The air conditioning system according to claim 1, wherein at the server processor or circuit, the parser process related to monitoring of the air conditioner parses the air conditioning data which is received, converts the air conditioning data which is parsed into air conditioning data that is recognized by the air conditioner, and transmits the converted air conditioning data to the monitor processor or circuit for operation of the air conditioner.

10. The air conditioning system according to claim 1, wherein at the server processor or circuit, the parser process related to monitoring of the air conditioner:

parses the air conditioning data which is received from the monitor processor or circuit assuming that the air conditioning data is as from the air conditioner, and analyzes the parsed air conditioning data, and parses the air conditioning data which is received, converts the air conditioning data which is parsed into air conditioning data that is recognized by the air conditioner, and transmits the converted air conditioning data to the monitor processor or circuit.

11. The air conditioning system according to claim 1, wherein at the server processor or circuit, the parser process related to monitoring of the air conditioner:

parses the air conditioning data which is received from the monitor processor or circuit assuming that the air conditioning data is as from the air conditioner, analyzes the parsed air conditioning data, and stores the analyzed air conditioning data, and parses the air conditioning data which is received, converts the air conditioning data which is parsed into air conditioning data that is recognized by the air conditioner, and transmits the converted air conditioning data to the monitor processor or circuit, wherein the air conditioning data which is received is operation data and the converted air conditioning data includes an operation command to the air conditioner.

* * * * *